US008950595B2

(12) United States Patent
Ammon

(10) Patent No.: US 8,950,595 B2
(45) Date of Patent: Feb. 10, 2015

(54) APPARATUSES AND METHODS FOR DISHWASHER RACK EMPTYING

(71) Applicant: Justin Ammon, Redondo Beach, CA (US)

(72) Inventor: Justin Ammon, Redondo Beach, CA (US)

( * ) Notice: Subject to any disclaimer, the term of this patent is extended or adjusted under 35 U.S.C. 154(b) by 0 days.

(21) Appl. No.: 14/057,603

(22) Filed: Oct. 18, 2013

(65) Prior Publication Data

US 2014/0110362 A1 Apr. 24, 2014

Related U.S. Application Data

(60) Provisional application No. 61/715,744, filed on Oct. 18, 2012.

(51) Int. Cl.

| | |
|---|---|
| ***A47G 19/08*** | (2006.01) |
| ***A47L 15/50*** | (2006.01) |
| *A47B 73/00* | (2006.01) |
| *B65D 25/24* | (2006.01) |
| *B65D 1/24* | (2006.01) |
| *B65D 21/00* | (2006.01) |

(52) U.S. Cl.

CPC ..... *A47L 15/50* (2013.01)
USPC ..... 211/41.8; 211/74; 220/630; 220/501; 206/509

(58) Field of Classification Search

CPC ..... A47J 47/16; A47L 15/50; A47L 15/48; A47L 15/0076; A47L 15/504; A47L 15/502; A47B 1/06
USPC ..... 211/41.8, 41.9, 126.12, 126.4, 126.7, 211/126.11, 126.15, 201, 71.01, 74, 76; 220/629, 630, 628, 636, 529, 501, 528, 220/527, 504, 507, 4.03, DIG. 6; 206/561, 206/565, 501, 509; 134/25.2, 56 D, 57 D, 134/58 D

See application file for complete search history.

(56) References Cited

U.S. PATENT DOCUMENTS

| | | | | |
|---|---|---|---|---|
| 1,961,391 | A * | 6/1934 | Reedy | 99/446 |
| 2,456,481 | A * | 12/1948 | Ballantyne et al. | 34/238 |
| 2,718,326 | A * | 9/1955 | Le Blanc | 220/533 |
| 2,741,392 | A * | 4/1956 | Weiss | 220/488 |

(Continued)

FOREIGN PATENT DOCUMENTS

| | | | |
|---|---|---|---|
| EP | 0367559 | B1 | 5/1994 |
| EP | 2554096 | A2 | 2/2013 |
| JP | 2005034450 | A | 2/2005 |

*Primary Examiner* — Joshua J Michener
*Assistant Examiner* — Devin Barnett
(74) *Attorney, Agent, or Firm* — Joseph G. Swan, P.C.

(57) ABSTRACT

In one embodiment, a dishwasher rack includes: an interior structure divided into separate compartments, each sized and configured to hold an individual beverage container; a top side through which the compartments may be loaded; a bottom side having a support surface; and a release mechanism. The top and/or bottom side has a configurable surface that provides a closed configuration in which it is capable of supporting beverage containers and an open configuration in which beverage containers are able to pass through. When the dishwasher rack is placed on top of a desired exterior surface with the configurable surface immediately adjacent to the exterior surface, the release mechanism can be operated to change the configurable surface from the closed configuration to the open configuration, causing any enclosed beverage containers to drop down onto the exterior surface and remain there when the dishwasher rack is lifted up and away.

18 Claims, 19 Drawing Sheets

(56) References Cited

U.S. PATENT DOCUMENTS

| | | | | | |
|---|---|---|---|---|---|
| 3,009,579 | A | | 11/1961 | Ettlinger, Jr. | |
| 3,217,890 | A | * | 11/1965 | Maslow | 211/41.8 |
| 3,245,548 | A | * | 4/1966 | Kesilman et al. | 211/41.2 |
| 3,252,582 | A | * | 5/1966 | Kesilman et al. | 211/41.2 |
| 3,283,915 | A | * | 11/1966 | Maslow | 211/126.2 |
| 3,442,397 | A | | 5/1969 | Jaffee et al. | |
| 3,451,557 | A | | 6/1969 | Stoddard | |
| 3,482,707 | A | | 12/1969 | Weiss | |
| 3,568,848 | A | * | 3/1971 | Tzifkansky | 211/41.8 |
| 3,584,744 | A | | 6/1971 | Ettlinger, Jr. | |
| 3,672,530 | A | * | 6/1972 | Bridenstine et al. | 220/4.03 |
| 4,106,625 | A | * | 8/1978 | Carroll et al. | 206/507 |
| 4,169,532 | A | * | 10/1979 | Scapellati | 206/557 |
| D259,818 | S | * | 7/1981 | Beavis | D3/311 |
| 4,291,804 | A | * | 9/1981 | Weidt | 206/509 |
| 4,499,997 | A | * | 2/1985 | Swingley, Jr. | 206/509 |
| 4,527,707 | A | * | 7/1985 | Heymann et al. | 220/571 |
| 4,909,401 | A | | 3/1990 | McConnell | |
| 5,071,026 | A | * | 12/1991 | Apps | 220/516 |
| 5,197,626 | A | * | 3/1993 | Bernstein | 220/507 |
| 5,390,811 | A | * | 2/1995 | Ogino et al. | 220/326 |
| 5,415,293 | A | * | 5/1995 | Ackermann et al. | 206/506 |
| 5,439,108 | A | * | 8/1995 | Lackie | 206/373 |
| 5,483,899 | A | * | 1/1996 | Christie | 108/56.3 |
| 5,514,343 | A | * | 5/1996 | Verwohlt et al. | 422/75 |
| 5,544,751 | A | * | 8/1996 | Klodt et al. | 206/509 |
| 5,580,025 | A | | 12/1996 | Cross | |
| 5,605,236 | A | * | 2/1997 | Welch | 211/41.8 |
| 5,628,405 | A | * | 5/1997 | Price et al. | 206/561 |
| 5,671,986 | A | | 9/1997 | Vinet | |
| 5,797,488 | A | * | 8/1998 | Yemini | 206/349 |
| 5,855,291 | A | * | 1/1999 | Ingle | 220/6 |
| 5,934,486 | A | * | 8/1999 | Jarvis et al. | 211/41.8 |
| 5,988,406 | A | | 11/1999 | Leipziger | |
| 6,098,819 | A | * | 8/2000 | Link | 211/85.13 |
| 6,123,204 | A | | 9/2000 | Nelson et al. | |
| 6,135,296 | A | * | 10/2000 | Colgrove | 211/41.8 |
| 6,321,925 | B1 | * | 11/2001 | Crouse et al. | 220/4.27 |
| 6,336,556 | B1 | * | 1/2002 | Gale | 206/427 |
| 6,634,510 | B2 | * | 10/2003 | Larson et al. | 211/41.8 |
| 6,726,031 | B2 | * | 4/2004 | Laupan | 211/41.8 |
| 6,874,634 | B2 | * | 4/2005 | Riley | 206/439 |
| 6,896,149 | B1 | * | 5/2005 | Berry, III | 220/4.28 |
| 6,997,340 | B1 | * | 2/2006 | Stefanik et al. | 220/507 |
| 7,237,686 | B2 | * | 7/2007 | Bertrand et al. | 211/74 |
| 7,249,686 | B1 | * | 7/2007 | Aesquivel | 220/556 |
| 7,630,791 | B2 | * | 12/2009 | Nguyen et al. | 700/242 |
| 2002/0117461 | A1 | | 8/2002 | Laupan | |
| 2003/0178378 | A1 | * | 9/2003 | Larson et al. | 211/41.8 |
| 2004/0089625 | A1 | * | 5/2004 | Tsai | 211/126.2 |
| 2004/0118854 | A1 | * | 6/2004 | Kutun | 220/507 |
| 2005/0023281 | A1 | * | 2/2005 | Bradford | 220/528 |
| 2007/0062888 | A1 | * | 3/2007 | Russell | 211/41.9 |
| 2009/0050587 | A1 | * | 2/2009 | Sandor | 211/74 |
| 2010/0000514 | A1 | * | 1/2010 | Baker et al. | 126/339 |
| 2010/0083577 | A1 | * | 4/2010 | Flannery et al. | 49/130 |
| 2010/0326936 | A1 | * | 12/2010 | Hanley | 211/86.01 |
| 2011/0284555 | A1 | * | 11/2011 | Barringer et al. | 220/592.01 |
| 2012/0085767 | A1 | * | 4/2012 | Read et al. | 220/523 |
| 2012/0223083 | A1 | * | 9/2012 | Hug | 220/507 |
| 2013/0000202 | A1 | * | 1/2013 | Flannery et al. | 49/116 |
| 2013/0025472 | A1 | * | 1/2013 | Stanger | 99/448 |
| 2013/0233353 | A1 | * | 9/2013 | Vacca et al. | 134/25.2 |
| 2014/0010629 | A1 | * | 1/2014 | Abraham | 414/802 |

* cited by examiner

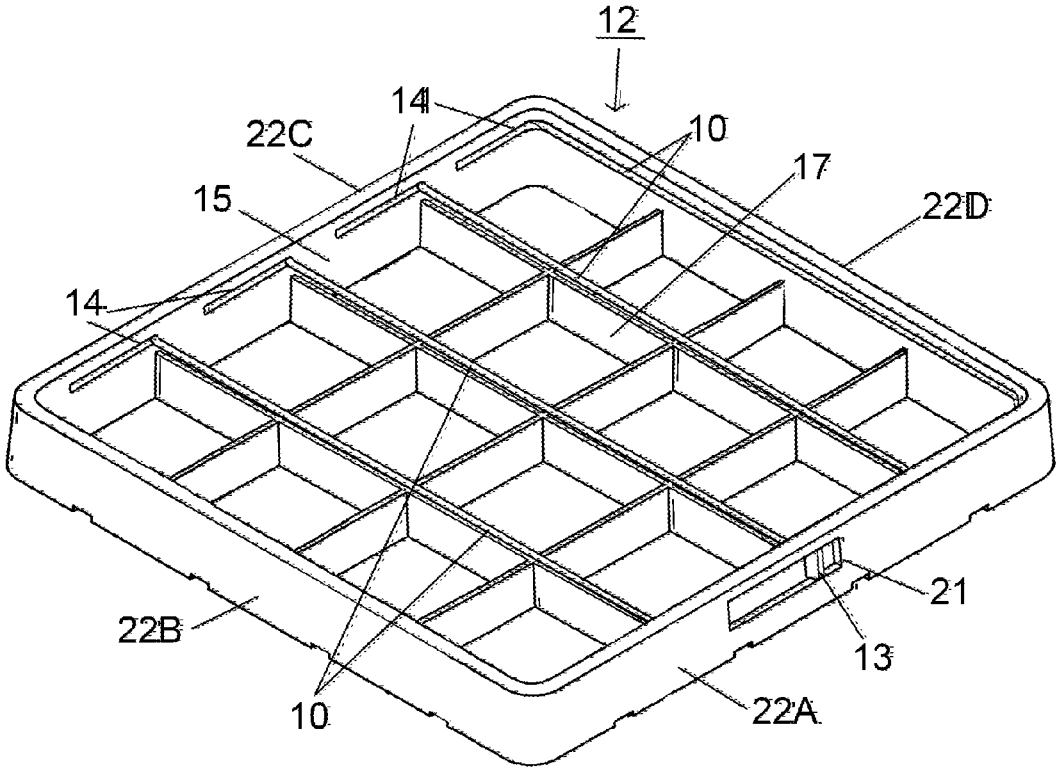
FIG. 1-A

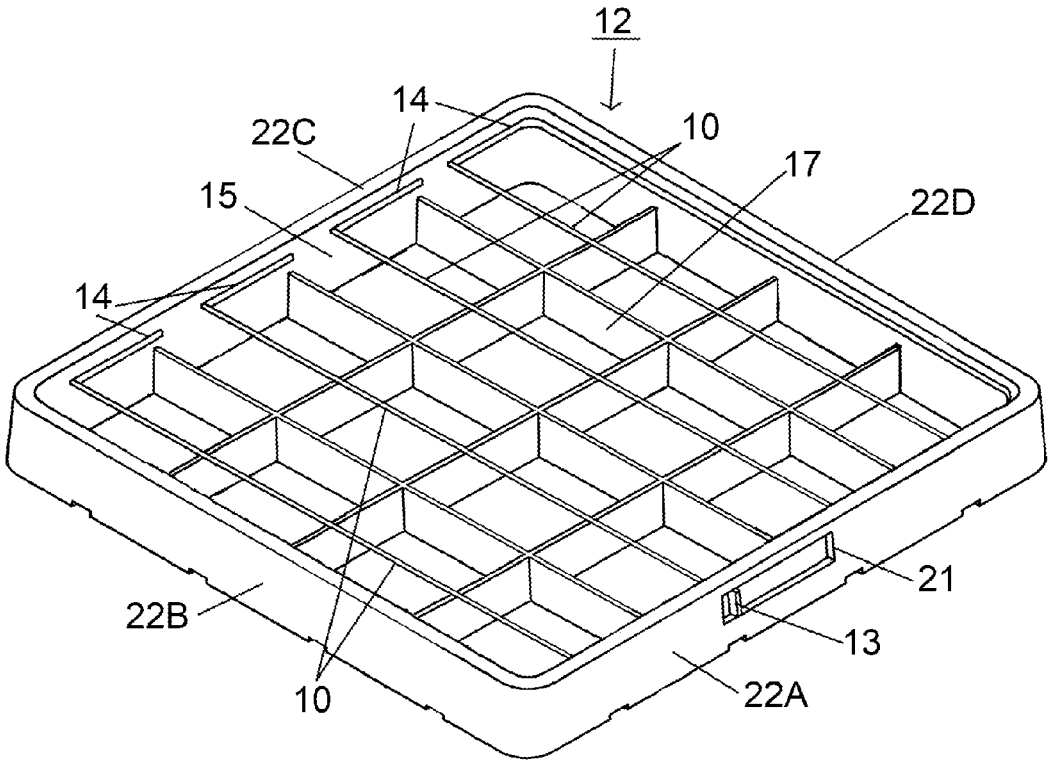
FIG. 1-B

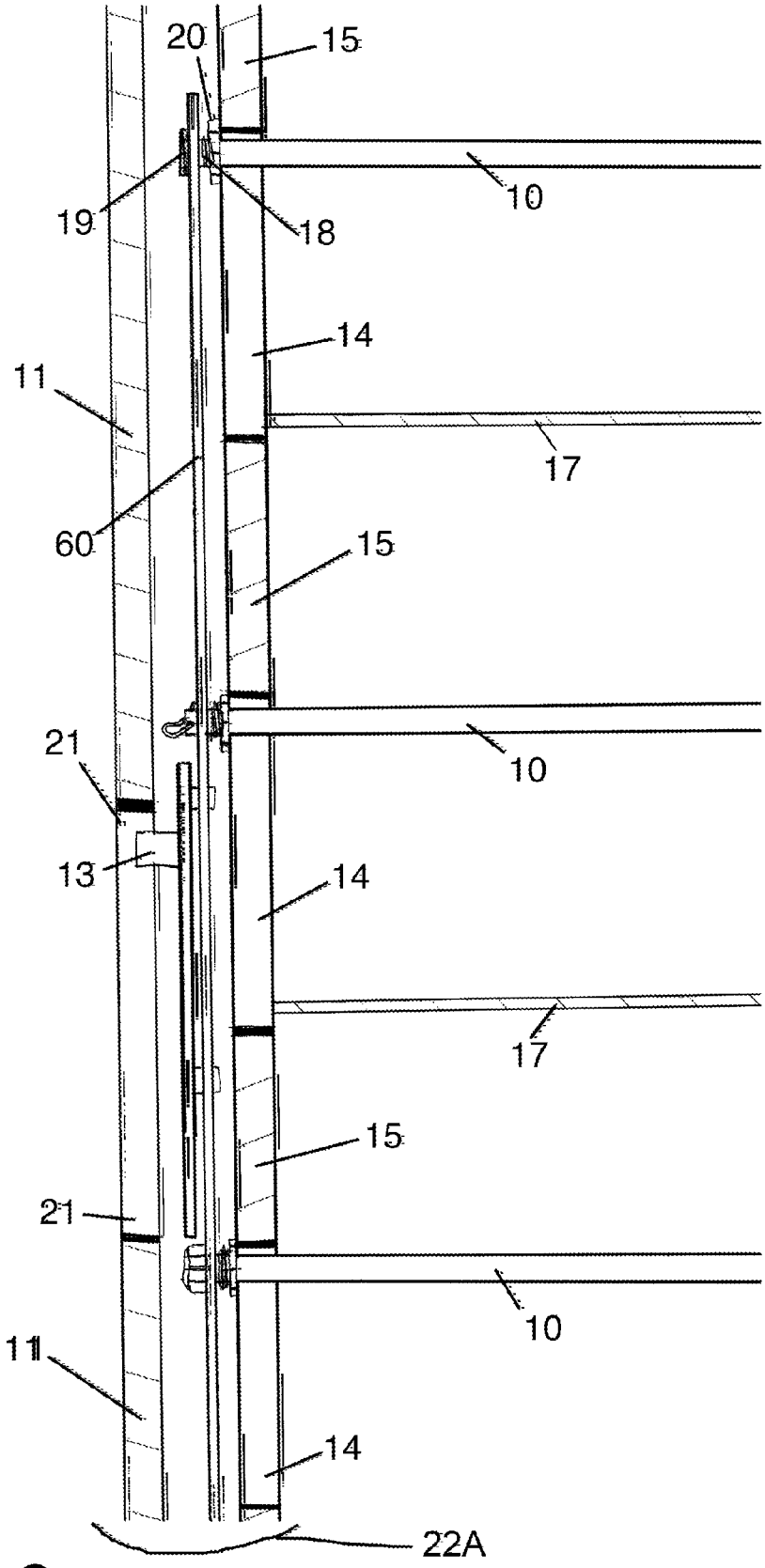
FIG. 1-C

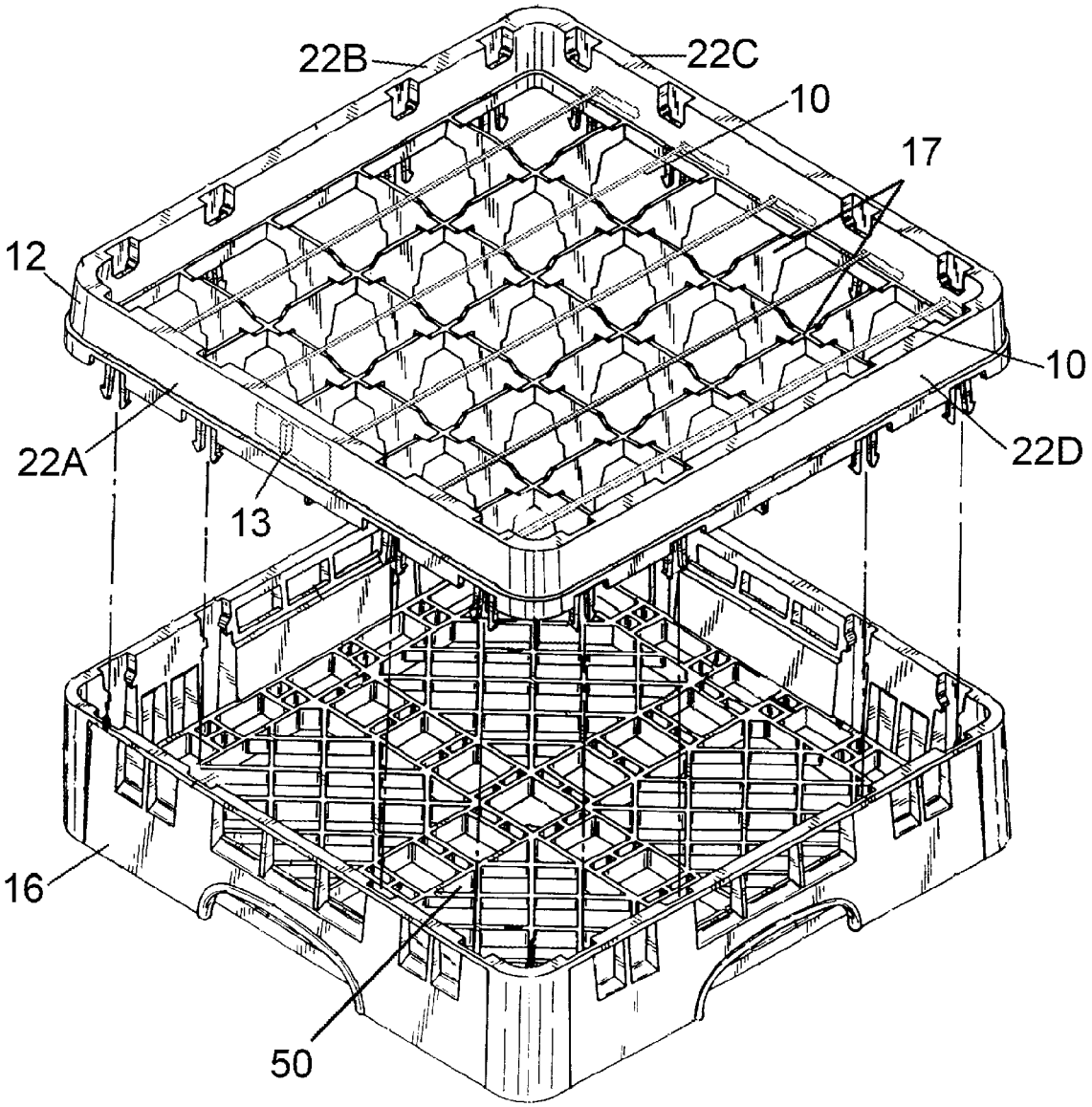
FIG. 1-D

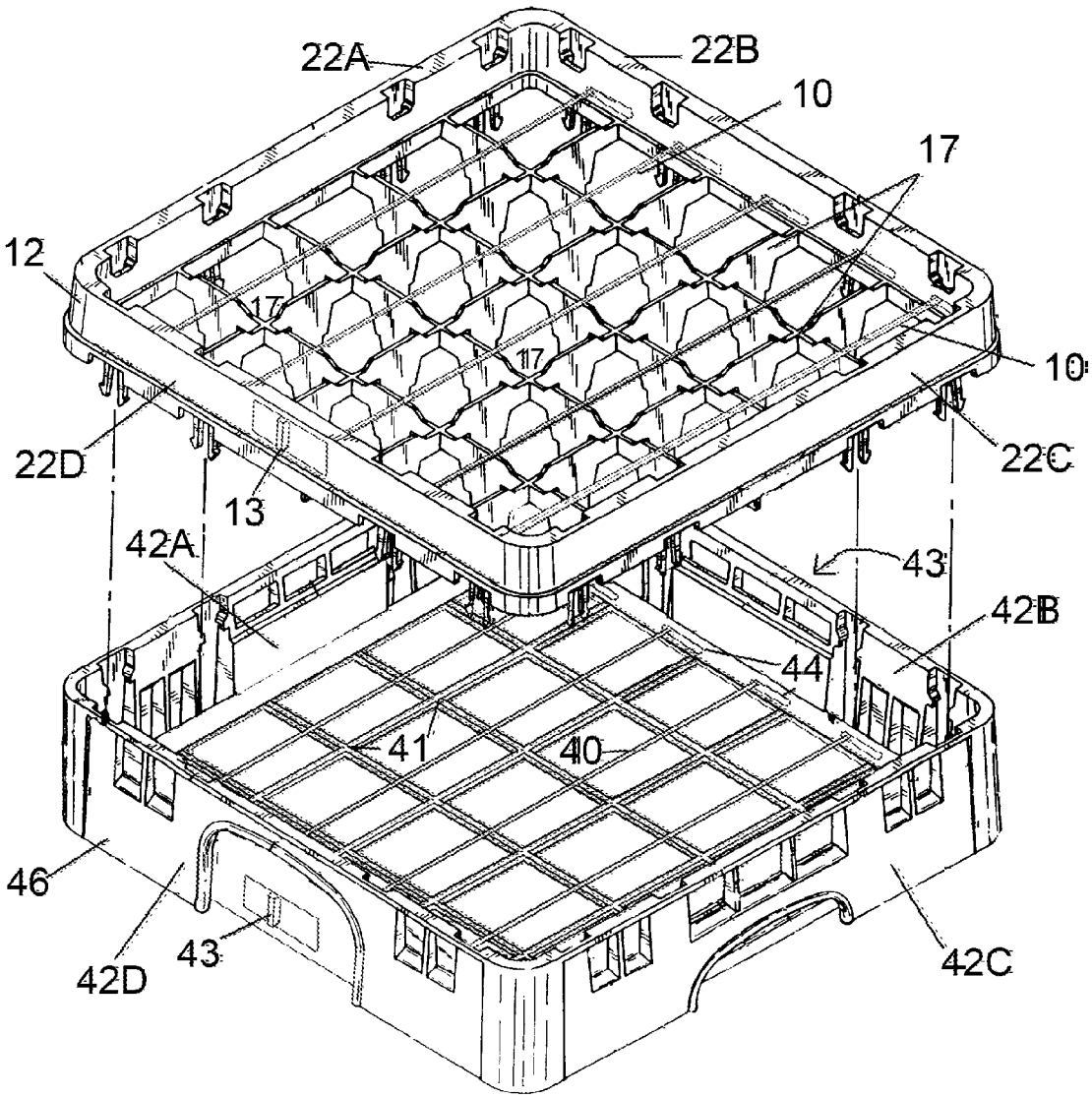
FIG. 1-E

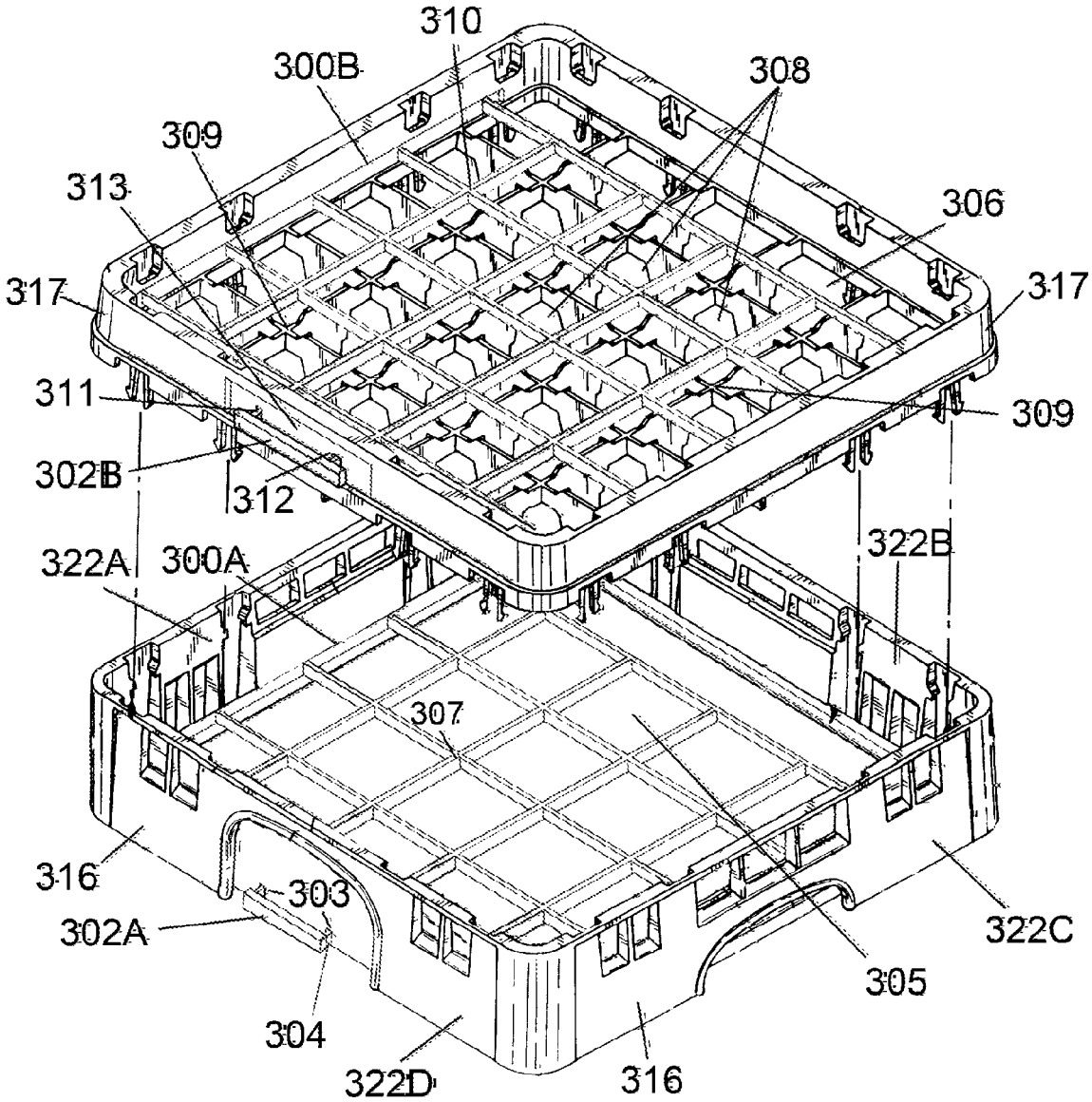
FIG. 3-A

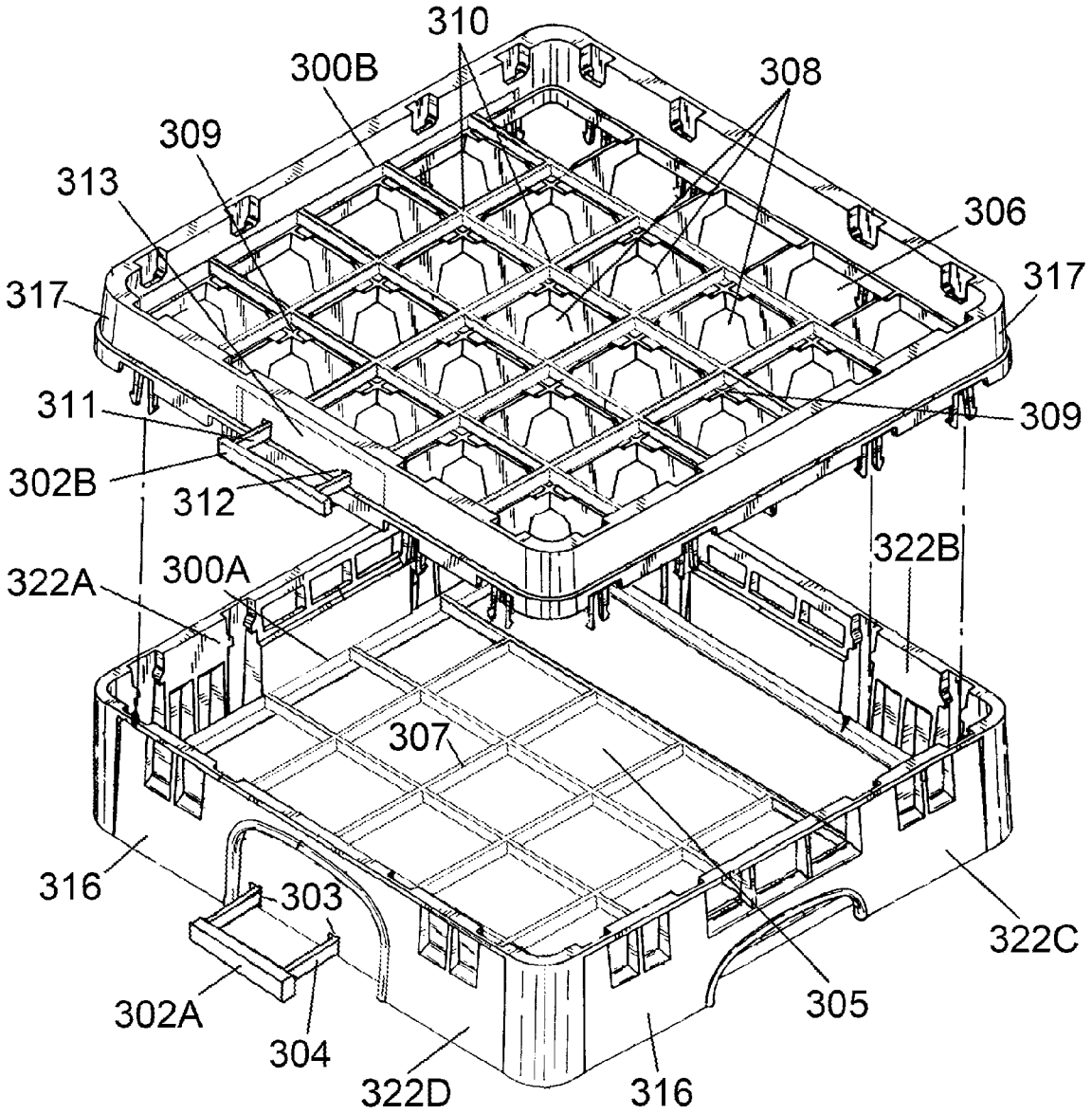
FIG. 3-B

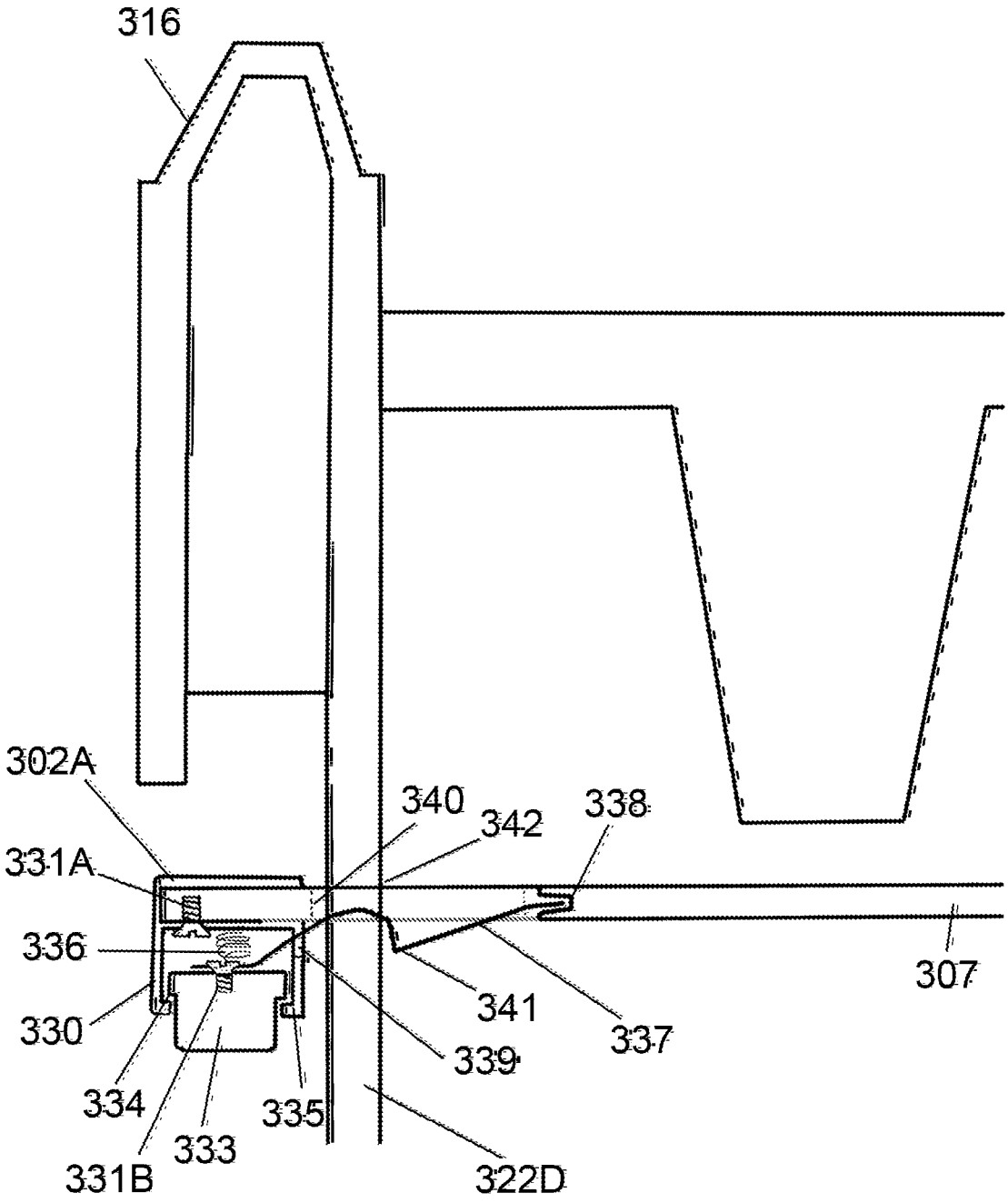
FIG. 3-C

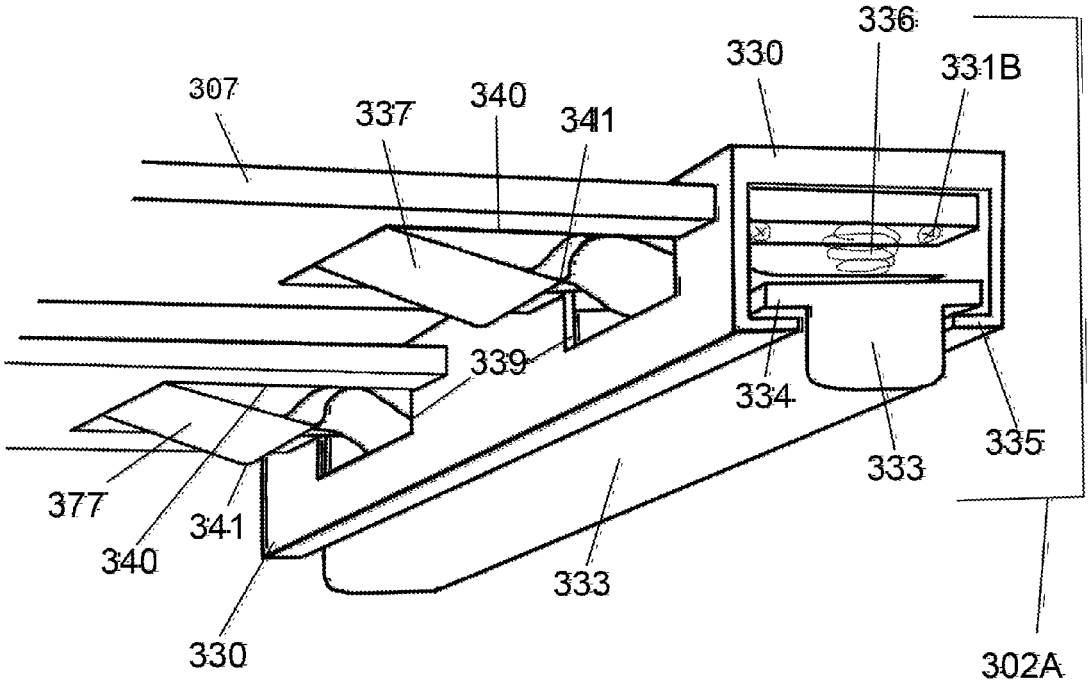
FIG. 3-D

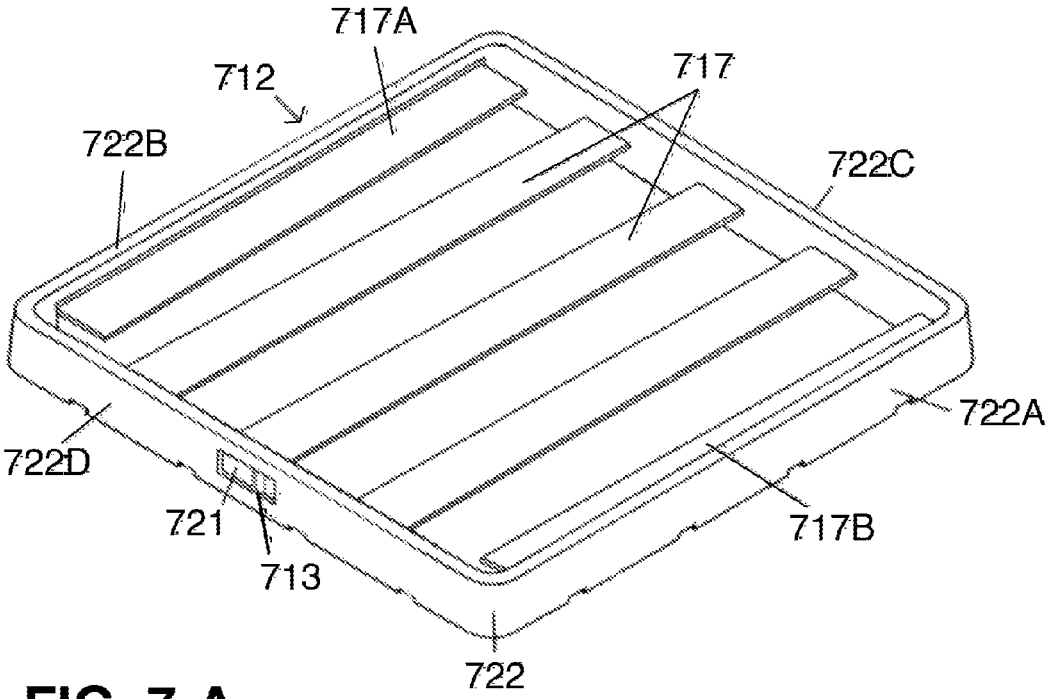
FIG. 7-A

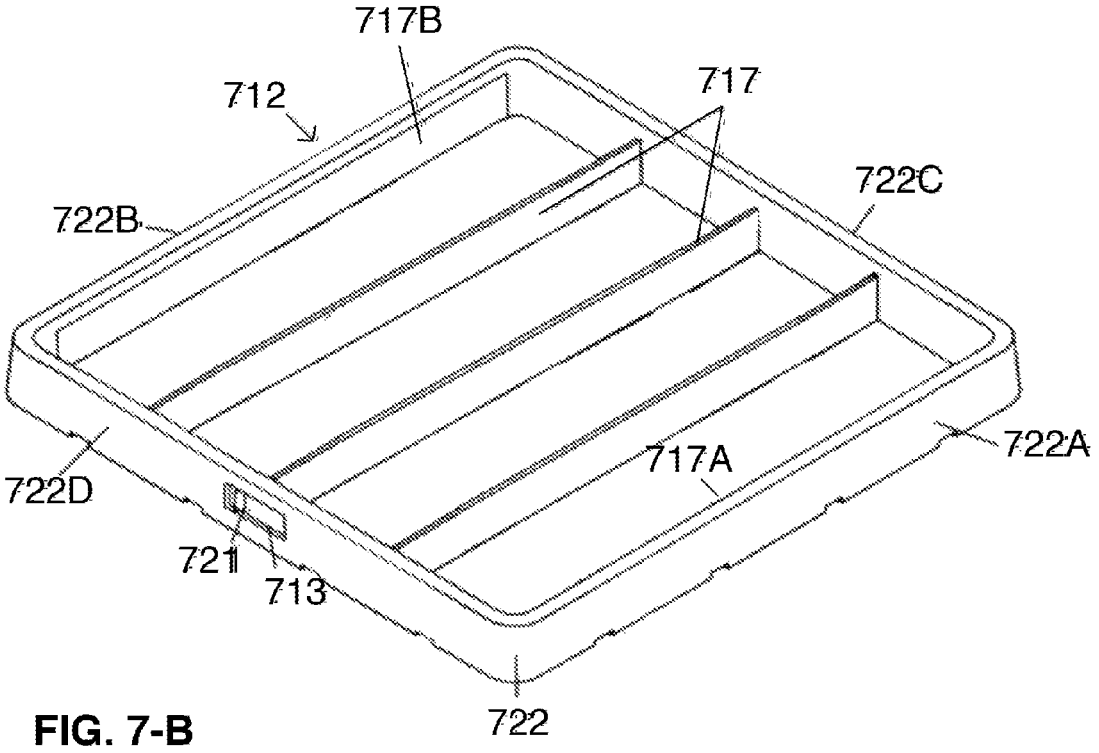
FIG. 7-B

APPARATUSES AND METHODS FOR DISHWASHER RACK EMPTYING

This application claims the benefit of U.S. Provisional Patent Application Ser. No. 61/715,744, filed on Oct. 18, 2012, which application is incorporated by reference herein as though set forth herein in full.

FIELD OF THE INVENTION

The present invention pertains, among other things, to apparatuses, systems, methods and techniques for facilitating the emptying of a dishwasher rack, and is particularly applicable to commercial dishwasher racks.

BACKGROUND

It is common in the restaurant, food service, and beverage industry to use automatic dishwashers that accept a standard dishwasher rack for cups and glasses. Generally speaking, a conventional dishwasher rack is in the shape of a rectangular (typically square) box with a bottom panel and four sidewalls, but an open top. Within this box is a rectangular grid of walls or slats, defining a matrix of compartments into which glasses or cups may be inserted, typically having paddle-shaped walls that extend higher in the center thereof than at the ends so as to protect glasses placed in the compartments and yet permit water to flow through a substantial portion of the dividers. The grid typically is molded so as to be integral with the sidewalls and includes a multiplicity of shapes and number of compartments and sizes to fit a wide variety of sizes of glasses. For example two common rack configurations contain four or five rows and columns of compartments (i.e., 4×4 or 5×5). The compartments of the adjacent rows and columns typically are nested with one another, so that adjacent compartments share a wall.

Different racks with different sized compartments commonly are used to most closely match the diameter of the glasses or cups being washed. However, a conventional dishwasher rack typically is 19.72"×19.72" and is divided into 16 compartments (4×4), with each compartment able to hold a glass with a diameter of 4.25 inches or less, or is divided into 25 compartments (5×5), with each compartment able to hold a glass with a diameter of 3.35 inches or less, e.g., as described in U.S. Pat. Nos. 2,741,392, 3,283,915, 3,442,397, 3,584,744, 3,009,579, 3,245,548, 3,482,707 and 4,621,739, as well as in U.S. Patent Application Publication No. 2002/0117461. The forgoing sizes given for the compartments in a dishwasher rack are just examples of commonly used configurations, it being understood that many compartments having many other configurations, in terms of number of compartments and sizes of compartments, are available and useful for washing cups and glasses.

A conventional dishwasher rack can consist of a single component (which can be referred to as a base component) having the foregoing configuration. Alternatively, one or more "rack extenders", e.g., as discussed and/or shown in U.S. Pat. Nos. D399,614, D400,321 and in U.S. Patent Application Publication Nos. 2003/0178378 and 2002/0117461 can be attached to the base component to increase the height or to change the number, the size or the configuration of the interior compartments of the rack, and thereby accommodate taller glasses or cups or such different sizes or configurations. These one or more extenders are stacked one on top of the base component and then on top of each other, with all the components typically fitting together and being held in place by a number of interlocking pins and receiving sockets, e.g., as described and/or shown in U.S. Pat. Nos. 3,283,915, 3,584,744, D399,614 and D400,321, as well as in U.S. Patent Application Publication Nos. 2002/0117461 and 2003/0178378. A rack extender typically is similar to the base unit in cross-section, having the same (or roughly the same) length and width and a matching internal grid, but has both an open bottom and an open top. Such dishwasher racks provide for easy transport of cups and glasses and work well in many cases.

SUMMARY OF THE INVENTION

However, the present inventor has discovered that problems arise in connection with these conventional structures, particularly when high volumes of cups and/or glasses are required for service in a busy restaurant, bar, event or other venue. In this case, service staff spends a significant amount of time unloading dishwasher racks of cups and glasses. To empty a conventional dishwasher rack of its contents, each cup or glass typically must be lifted out of its compartment by hand. The time spent emptying cups and glasses from a dishwasher rack becomes significant when many cups or glasses are needed and multiple racks must be emptied.

In addition to the time spent emptying commercial dishwasher racks by hand, one glass at a time, this method of emptying the rack sometimes is not sanitary because each clean glass mush be touched by hand in order to remove the glass from the dish rack, and when working in a commercial kitchen a worker's hands can become easily soiled or otherwise exposed to non-sanitary surfaces.

In one respect, the present invention addresses these problems by providing a dishwasher rack that has a configurable or releasable surface (which can be either or both of its top surface and/or its bottom surface), that can be configured to hold glasses, cups or other beverage containers within, and that when the rack is in a position in which the configurable surface is facing and immediately adjacent to (e.g., within a short distance from) a second surface (such as a countertop, tabletop or a tray), the configurable surface can be easily changed to release the cups, glasses and/or other beverage containers so that they fall (usually a very short distance, e.g., less than 1-2 inches) to the second surface. After that, the rack can be lifted up, leaving the beverage containers on the second surface.

According to one particular aspect, the present invention provides for a mechanism to hold and/or lock beverage containers securely into a dishwasher rack, thereby enabling the dishwasher rack to be inverted (turned upside down) while keeping the beverage containers securely held within the dishwasher rack. With the dishwasher rack inverted (upside down) the dishwasher rack is placed on any desired (e.g., flat) surface (e.g., a tray, countertop or tabletop), and then the securing mechanism is released, causing the beverage containers within the dishwasher rack to drop out of the rack onto the desired surface. The release of beverage containers from the dishwasher rack, as described above, allows the empty dishwasher rack to be lifted away from the flat surface, leaving the beverage containers behind on the selected surface (e.g., without leaving behind any portion of the dishwashing apparatus).

According to another aspect, the invention provides for a similarly releasable mechanism to be installed in (or as) the floor (or bottom surface) of the dishwasher rack. Such a structure allows beverage containers to be loaded into the rack through the top openings of the rack compartments (in the same manner as a conventional dishwasher rack is loaded) but, unlike conventional racks, this rack can be emptied all at once by releasing the cups, glasses and/or other beverage containers through the floor (or bottom) of the dishwasher rack, without inverting the rack (and, again, without manually removing each one from its separate compartment).

Still further, both of the foregoing mechanisms (for locking or securing the contents of the dishwasher rack into the rack and for releasing the contents of the dishwasher rack through the top and/or bottom surface of the rack), or aspects of them, may be incorporated together in the same rack. A dishwasher rack having a combination of these structures (i.e., securing and releasing capabilities in both the top and the bottom surfaces of the rack) is desirable when cups, glasses and/or other beverage containers are being transported or for any other reason when it is advantageous to secure or lock them into the rack and, at the same time, to have an ability to empty the rack relatively easily and, in some cases, without inverting it.

The described systems, methods and apparatuses that use a releasable mechanism to lock cups, glasses and/or other beverage containers into a dishwasher rack so that the rack can be inverted and then the contents released onto a different surface and/or use a releasable mechanism that allows the contents of the dishwasher rack to be removed all at once through the floor or bottom of the rack permit a much quicker method of emptying a dishwasher rack than is currently available. Additionally, the described systems facilitate the emptying of a commercial dishwasher rack of glasses without the need to touch each glass by hand, thereby reducing the risk of unsanitary hands coming into contact with a drinking glass during the process of removing the cups, glasses and/or other beverage containers from the dishwasher rack.

Thus, one embodiment of the invention is directed to a dishwasher rack that includes: an interior structure divided into separate compartments, each sized and configured to hold an individual beverage container; a top side through which the compartments may be loaded; a bottom side having a support surface; and a release mechanism. The top and/or bottom side has a configurable surface that provides a closed configuration in which it is capable of supporting beverage containers and an open configuration in which beverage containers are able to pass through. When the dishwasher rack is placed on top of a desired exterior surface with the configurable surface immediately adjacent to the exterior surface, the release mechanism can be operated to change the configurable surface from the closed configuration to the open configuration, causing any enclosed beverage containers to drop down onto the exterior surface and remain there when the dishwasher rack is lifted up and away.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the attached drawings. However, it should be understood that the drawings merely depict certain representative and/or exemplary embodiments and features of the present invention and are not intended to limit the scope of the invention in any manner. The following is a brief description of each of the attached drawings.

FIG. 1-A is a perspective view of a rack extender having a configurable surface on its top side, configured in the closed position; FIG. 1-B is a perspective view of the rack extender with its configurable surface changed to the closed position; FIG. 1-C illustrates a sectional view of a portion of the front edge of the rack extender; FIG. 1-D is a perspective exploded view of a rack that includes a base component and the extender component; and FIG. 1-E is a perspective exploded view of a rack that includes an alternate base component and the extender component.

FIG. 3-A is an exploded view of a dishwasher rack having movable grids in its base portion and in its extender portion, both in the closed positions; FIG. 3-B is an exploded view of the dishwasher rack having its movable grids in the open positions; FIG. 3-C is a sectional view of a portion of the dishwasher rack; and FIG. 3-D is a perspective view of a portion of the dishwasher rack.

FIGS. 7-A and 7-B are perspective views of a dishwasher rack extender having rotating dividing supports.

DESCRIPTION OF CERTAIN REPRESENTATIVE EMBODIMENTS

Figure 2:
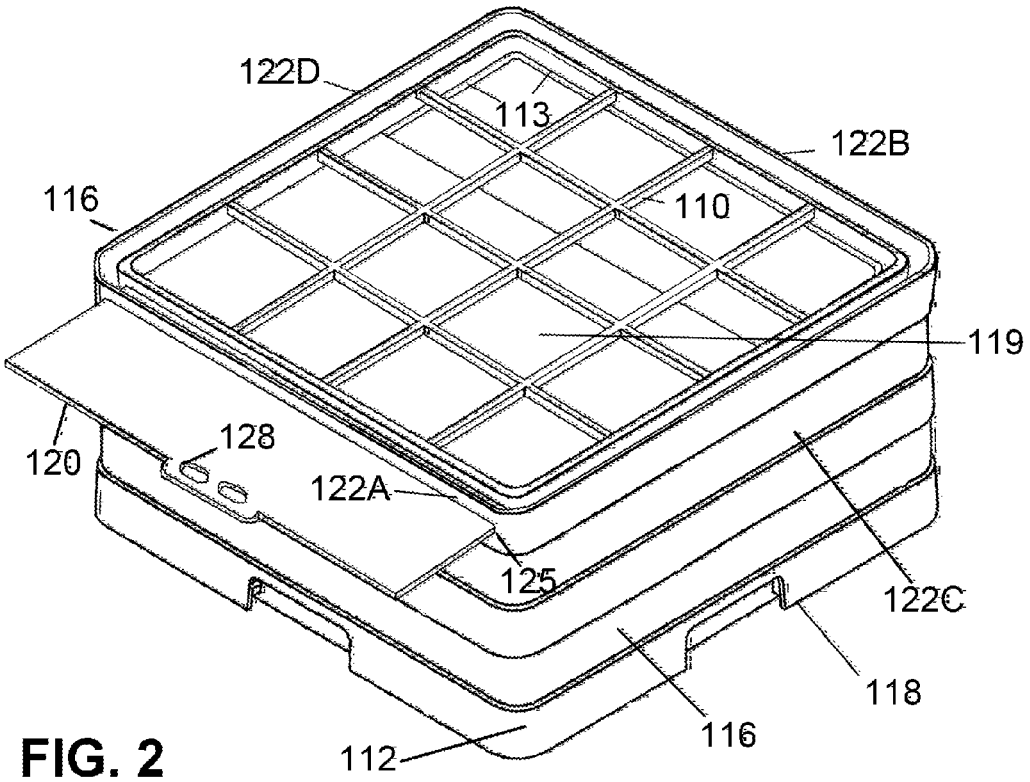
FIG. 2 is a perspective view of a dishwasher rack having a removable panel.

As discussed in greater detail below, an apparatus according to the present invention can encompass: (i) an entire dishwasher rack, (ii) a "rack extender", and/or (iii) one or more components that can be used with either. A rack extender 12 according to the present invention is illustrated in FIGS. 1-A, 1-B and 1-C, while dishwasher racks 16 and 46 which include extender 12 are illustrated in FIGS. 1-D and 1-E.

The initial embodiment of the present invention concerns a modified rack extender 12 and the use thereof in a dishwasher rack 16. In this embodiment, rack extender 12 is simply placed on top of the rest of dishwasher rack 16, in the same manner as a conventional rack extender.

As shown in FIGS. 1-A and 1-B, rack extender 12 is of conventional construction except for: (i) the inclusion of and ability to accommodate parallel rods 10; and (ii) a mechanism 13 to move the rods between the open position (shown in FIG. 1-A) and the closed position (shown in FIG. 1-B). More specifically, rack extender 12 preferably has a conventional frame 22 made of four side walls 22A-D, which typically are arranged in a substantially square or rectangular shape, e.g., usually with the standard dimensions noted above. Within frame 22 is a conventional open grid 17 that separates the individual beverage containers (e.g., cups, mugs and/or glasses). As with conventional rack extenders, rack extender 12 has an open bottom surface, but instead of having a perpetually open top surface, the top surface of rack extender 12 is adjustable and can be configured to be open or closed. In the present embodiment, this adjustability is accomplished through the use of a set of movable parallel rods 10.

Referring to FIG. 1-C, in the present embodiment each of parallel rods 10 is fitted with a bushing 20 and is secured by threads 18 and a c-pin 19 to a carrier 60 that is disposed between the inside wall 15 and the outside wall 11 (which together make up the front wall 22A) of the rack extender 12. Also attached to carrier 60 is a sliding tab, grip, handle or other element (referred to as a "tab" herein) 13 that is exposed through a slot 21 in the outside wall 11 of the front wall 22A. A similar or identical carrier 60 preferably also is provided within the wall 22C that is directly opposite and parallel to wall 22A, and a tab 13 also can be provided in the wall 22C. In alternate embodiments, a single tab 13 is provided just in the front wall 22A or just in the rear wall 22C that is directly opposite and parallel to wall 22A. In the present embodiment, these tab(s) 13 terminate just inside the outer surface of outside wall 11 (as shown in FIG. 1-C) or at most is/are flush with such outer surface.

When sliding tab 13 is in the open position shown in FIG. 1-A, the parallel rods 10 extend through slots 14 in the inner side wall 15 of front and rear structural side walls 22A&C and align exactly with the grid 17 of the dishwasher rack compartments, with one additional rod 10 disposed within a groove in the right side wall 22D. When the sliding tab 13 is then moved by a user into the closed position (as shown in FIG. 1-B), the carrier 60 also is moved, which in turn also moves the attached parallel rods 10 out of alignment with the compartment grid 17 and into a position approximately halfway between the parallel slats of grid 17 that extend perpendicular to the carrier 60. The result is to effectively obstruct the openings to all the compartments and thereby lock or secure the beverage containers into their respective compartments. A latching or locking mechanism preferably is used with the sliding tab 13, the carrier 60 or rods 10 to prevent the rods 10 from changing position accidentally. This latching or locking mechanism can be (or include), e.g., a pin, a snap-fit connection, a flexible and resilient lip engaging with another lip, an engagement slot (e.g., in slot 21) at each end of the range of travel of tab 13, or any other known temporary locking or securing mechanism.

Referring to FIG. 1-D, in the present embodiment the base of the dish rack 16 is a conventional rack commonly used in the industry, having sidewalls 22, but unlike extender 12 alone, rack 16 (or the base portion of it) includes a sturdy bottom surface or rack floor 50, typically with openings that are sufficiently small to prevent the beverage containers from falling through while still allowing water to flow through during the washing process. In the present embodiment, the top rack extender is extender 12, and any number of conventional extenders may be used between rack 16 and extender 12 to increase the height of the dishwasher rack according to a desired function.

The present invention can involve racks having any number, any size and/or any shape of compartments. In the embodiment described above, the inventive features are provided in the rack extender 12 portion of the dishwasher rack 16.

Preferably, any dish rack or rack extender in accordance with the invention is made primarily of molded plastic. For example, a polypropylene copolymer is a suitable material for the rack and extender. However, the rods 10 and carrier 60, as well as related components, can be made of other materials, such as plastic, metal and/or natural or synthetic rubber. Although rods 10 are referenced above, it should be noted that any kind of elongated members, having a rectangular, square or any cross-sectional shape, may be used instead of rods. Also, such elongated members 10, together with the carriers 60, may be formed in any other way, such as by molding or otherwise forming all of such components together as a unitary piece.

In accordance with the present method for using rack 16: sliding tab 13 is moved to the open position and latched or locked into place while the rack is empty of beverage containers, rack 16 is loaded with beverage containers while sliding tab 13 is in the open position; with the rack full of beverage containers sliding tab 13 is then moved to the closed position and locked or latched into place and placed into the automatic dishwasher; the dishwasher is started; upon completion, rack 16 is removed from the dishwasher and flipped over onto a desired surface; sliding tab 13 is unlocked and moved to the open position, causing the beverage containers to drop slightly down onto that surface; rack 16 is lifted up, leaving the beverage containers behind; and finally rack 16 is flipped over again and the foregoing process is repeated.

In the commercial food and beverage service industry it is common to place clean cups, glasses and/or other beverage containers containers on rubber drying mats. In accordance with the above mentioned process for use of a dishwasher rack 16, which includes a mechanism for quickly emptying the rack, it is recommended that, to prevent breakage of beverage containers, rack 16 be placed on to a rubber drying mat before operating tab 13 to empty the rack 16 of the beverage containers.

The following is a detailed description and method for use of an alternate embodiment of the invention described above in connection with FIGS. 1-A, 1-B and 1-C.

Referring to FIG. 1-E, in the present embodiment a structure similar to that provided in rack extender 12 and shown in FIGS. 1-A and 1-B is provided in the base component of a rack, e.g., rack base 46. Here, rather than having a fixed bottom surface or floor, the base component includes a set of parallel elongated members 40 that cover and obstruct the areas directly beneath the lower openings of the compartments formed by grid 17 of the upper rack extender 12 when in the closed position, thereby substantially forming the floor of the rack 46, such that any glasses or other beverage containers placed into the rack will be resting on and be suspended within the rack 46 by the parallel members 40. The parallel members 40 are connected through slots, or channels 44 located in the inner side walls 42B and 42D of rack 46. The set of parallel members 40 are connected to a carrier mechanism similar or identical to that described above and illustrated in FIG. 1-C which lies between the inner and outer sidewalls of the rack 46 and is attached to sliding tabs 43 accessible on the outer side of walls 42D and 42B. Sliding tabs 43 are designed to allow for the control and operation of the elongated members 40 from outside of the rack 46. Directly below the elongated members 40 is a support grid 41 having the same dimensions and configuration as that of grid 17 in the above rack extender 12 and aligning exactly with the grid 17 of the rack extender 12. Grid 41 is made integral with the walls of rack 46 and is designed to strengthen rack 46 and provide additional support for the parallel members 40.

In accordance with the present method for using rack 46 (i.e., the base component with extender 12 attached): sliding tabs 43 are moved to the closed position and latched or locked into place while the rack is empty of glasses; sliding tabs 13 are moved to the open position moving the set of elongated members 10 into alignment with the dividers 17 of the extender 12, thereby opening the tops of the compartments of extender 12 and allowing beverage containers to be loaded into the rack 46; rack 46 is then loaded with beverage containers; and sliding tabs 13 are moved to the closed position, locking and securing the glasses into the rack such that the beverage containers will not fall out of the rack even when the rack is turned upside down or inverted (e.g., thereby allowing for storage and/or safe transport of a rack 46 full of beverage containers). Once filled with beverage containers, rack 46 is placed into the automatic dishwasher; the dishwasher is started; upon completion, rack 46 is removed from the dishwasher placed onto a desired surface; sliding tabs 43 are unlocked and moved to the open position, causing the beverage containers to drop slightly down our of the bottom of rack 46 onto that surface; rack 46 is lifted up, leaving the beverage containers behind; and the foregoing process is repeated.

FIG. 2 illustrates a rack 116 in the inverted (or upside down) position, according to an alternate embodiment of the present invention. Rack 116 preferably is similar to a conventional dishwasher rack (e.g., using any of the same general structure, dimensions and/or materials mentioned above), but instead of having a fixed, closed, integral bottom, rack 116 instead can be configured so as to be open at its bottom 118 as well as at its top 119. More specifically, rack 116 includes a removable bottom panel 120 that forms the floor of rack 116 when the panel 120 is inserted into the lower receiving slot 125 near the bottom edge of the front wall 122A, slid all the way in until it reaches the rear wall 122B and, preferably, then locked or otherwise secured in place, e.g., by using a simple latch, one or more clips, a snap-fit connection, a flexible and resilient lip engaging another lip, a slot-and-tab locking mechanism (e.g., rotating the tab into the slot), and/or any other mechanism. Although the removable panel 120 is shown as a solid piece, in reality it often will have a number of small openings (for example, configured as a mesh or molded plastic with circular holes) that allow water to freely flow through the panel. In the present embodiments, rack 116 includes grooves or channels 113 on the inside of right sidewall 122C and left side wall 122D for guiding and then helping to support panel 120, and also includes a groove 113 in rear wall 122B for accepting and then helping to support panel 120. In addition, the distal end of removable panel 120 and the groove 113 in rear wall 122B may be sized and shaped to form a snap fit, thereby providing at least one securing mechanism to hold panel 120 in place. Alternatively, rear wall 122B may be provided with one or more flexible and resilient clips for the same purpose. The support grid 110 located just below receiving slot 125 adds structural support to the rack 116 and to the removable floor panel 120 and preferably aligns exactly with the internal compartment grid of the rack. In the current embodiment, the structure for accommodating removable floor panel 120 is provided in the base component of rack 116, and any number of conventional extenders can be attached on top of this base component. As with rack 16, a polypropylene copolymer is a suitable material for the rack 116 and any extender.

In accordance with the present method for using rack 116: beverage containers are loaded into rack 116 with panel 120 fully inserted through receiving slot 125 and with rack 116 in the upright position (i.e., inverted from the view shown in FIG. 2); the dishwasher is started; upon completion, rack 116 is removed from the dishwasher and placed onto a desired surface; panel 120 is removed from slot 125 (e.g., by pulling on handle 128 after releasing any separate securing mechanism, either or both functioning as a release mechanism), causing the beverage containers to drop slightly down onto that surface; rack 116 is lifted up, leaving the beverage containers behind; and finally panel 120 is again fully inserted into receiving slot 125, the foregoing process can then be repeated as often as desired. As will be readily appreciated, as with the structure of rack 46, the structure of rack 116 eliminates two flips of the rack and, therefore, is often easier to use.

However, it should be noted that in alternate embodiments a similar (or identical) removable panel and similar (or identical) corresponding receiving structure instead (or in addition) are provided at the top surface of a rack according to the present invention. Also, in certain embodiments of the present invention, the top and bottom of the rack are identical to each other, so the designations "top" and "bottom" are just arbitrarily assigned. Still further, in alternate embodiments the structure for accommodating a removable panel 120 is provided in a rack extender, in addition to or instead of or in the base component of the rack.

A still further embodiment is now discussed in reference to FIGS. 3-A, 3-B, 3-C and 3-D. FIGS. 3-A and 3-B illustrate rack 316, which preferably is similar to rack 16 (e.g., using any of the same general structure, dimensions and/or materials mentioned above and having any of the features and variations described above). However, unlike rack 16, which has a closed, integral bottom, rack 316 instead is configured to be open at its bottom 305 as well as at its top 306. A sturdy but movable grid 307 forms the very bottom or floor of rack 316. More specifically, movable grid 307 is not integral with walls 322A-322D of rack 316, but instead has one or more components that extend into channels 300A in the inner walls 322A, 322B, 322D (but not in wall 322B). In the present embodiment, movable grid 307 has the same dimensions as the dividing grid 309 that forms the compartments 308 of rack extender 317. When handle 302A is in the closed position movable grid 307 crosses and thereby obstructs the lower openings of the compartments 308 formed by grid 309 such that any beverage containers placed into rack 316 (i.e., compartments 308) will be supported and rest securely on movable grid 307. Channels 300A allow the movable grid 307 to slide laterally toward and away from walls 322B and 322D inside of rack 316, e.g., by operating handle 302A that is attached to grid 317 by carriers 304, which in turn pass through slots 303 in side wall 322D of rack 316, thereby operatively connecting handle 302A to movable grid 307. As a result of this configuration, sliding movable grid 307 a one-half width within the structure of rack 316 switches between the open and closed positions. In the present embodiment, a sturdy movable grid 310 that is similar or identical to grid 307 (preferably having at least approximately the same dimensions) is built into the top most portion of rack extender 317. Movable grid 310 is attached to handle 302B by carriers 311 that pass through slots 312 in wall 313. Movable grid 310 has the same dimensions as the dividing grid 309 that forms the compartments 308 of rack extender 317. When handle 302B is in the closed position, movable grid 310 crosses and thereby obstructs the upper openings of the compartments 308 formed by grid 309 such that any beverage containers in the rack 316 (i.e., in compartments 308) after the closing of grid 310 will be held securely within rack 316 by the grids 307 below and 310 above, such that the beverage containers may not be released from the rack 316 until one of the movable grids is moved from the closed position to the open position. This allows for rack 316, when filled with beverage containers and with movable grids 307 and 310 in the closed and locked positions, to be turned at any angle, even inverted, without having any beverage containers fall out of the rack 316.

Referring to FIGS. 3-C and 3-D, the structure of handle 302A is shown most clearly in FIG. 3-C, which depicts a sectional side view of a portion of dishwasher rack 316, including a sliding grid 307 attached by carriers 304 to handle 302A. The exterior structure of handle 302A is handle housing 330, and handle 302A is attached to the sliding grid 307 at points on the interior of the handle 302A with a suitable standard fastener, such as a pan head screw 331A, and is affixed so the head of the fastener 331A is flush and flat, not protruding into the open space between the handle housing 330 and the plunger 333 such that it may obstruct the movement of plunger 333. Any reasonable number of fasteners 331A may be used to affix and hold the handle housing 330 firmly to sliding grid 307. The handle housing 330 is fitted with a button or plunger 333. The plunger 333 is held in place by its shape, having flanges 334 that fit into the handle housing and are secured into place by the hanger flanges 335 in the inside walls of the handle housing 330. Above the plunger 333 a coil spring 336 is fitted in the open space between the handle housing 330 and the plunger 333. A flat iron latch 337 is attached to the plunger 333 and secured by a fastener such as a pan head screw 331B. One end of a flat iron latch 337 is fitted into a groove or channel 338 in the sliding grid 307, and the opposite end of the flat iron latch 337 is secured by a fastener such as a pan head screw 331B to the plunger 333 inside the handle housing 330 and laying between the handle housing 330 and below the coil spring 336. The flat iron latch 337 runs through an opening 339 in the side of the handle housing 330. There is a space or window or gap 340 in the sliding grid 307 where the handle housing 330 affixes to the sliding grid 307. This gap 340 allows the flat iron latch 337 to be mounted within the thickness of the sliding grid 307 without inhibiting the movement of the sliding grid 307. The stopper or catch 341 of the flat iron latch is of an appropriate length so that when the sliding grid 307 is in the closed position, as in FIGS. 3-A and 3-C, the catch 341 is positioned just to the inside of the interior surface of wall 322D.

Preferably, any dish rack or rack extender in accordance with the invention is made primarily of molded plastic. For example, a polypropylene copolymer is a suitable material for the rack and extender. However, the sliding grid 307 and handle 302A, as well as related components, can be made of other materials, such as plastic, metal and/or natural or synthetic rubber. Although sliding grid 307 is referenced above, it should be noted that any kind of grid, having a rectangular, square or any cross-sectional shape, may be used instead. Also, such grid 307, together with the handle 302A, may be formed in any other way, such as by molding or otherwise forming all of such components together as a unitary piece.

Referring to FIG. 3-A illustrating rack 316 in the closed position and FIG. 3-B illustrating rack 316 in the open position: in accordance with the present method for using rack 316: in order to load beverage containers into rack 316 (i.e., compartments 308) handle 302B is placed in the open position (illustrated in FIG. 3-B) thus perfectly aligning grid 310 with compartment grid 309 and leaving the tops of compartments 308 unobstructed by any of the members of grid 310. Also before loading beverage containers into rack 316 handle 302A is moved into the closed and locked position (illustrated in FIG. 3-A) so that the carriers 304 attached to the handle 302A move base component grid 307 horizontally so that grid 307 is out of alignment with the compartment grids 309 and is covering the lower openings of compartments 308 of the above rack extender 317 thus creating the sturdy floor of the rack 316. When all compartments 308 have been filled with beverage containers handle 302*b* is then moved to the closed position (illustrated in FIG. 3-A), thereby locking and securing the beverage containers into the rack 316 such that the beverage containers will not fall out of the rack 316 even when the rack 316 is turned upside down or inverted, and thus allowing for storage or safe transport of a rack 316 full of beverage containers; with both handles of rack 316 in the closed and locked position the filled rack 316 is placed into the automatic dishwasher and the dishwasher is started; upon completion, rack 316 is removed from the dishwasher and placed onto a desired surface; handle 302, still being in the closed position, is now firmly grasped so that the plunger 333 is pressed fully up, compressing the coil spring 336 and lifting the end of the flat iron latch 337 so that the catch 341 is moved into parallel alignment with the sliding grid 307, thereby freeing the latch 337 and catch 341 to pass through the gap 342 in the sidewall 322D of the rack 316 without inhibiting or impeding or otherwise coming into contact with the inner side wall 322D of the rack 316; then, with handle 302 firmly grasped as described above, the handle 302 is pulled outwardly and away from the wall 322D of the rack 316, causing the sliding grid 307 to slide from the closed position to the open position (shown in FIG. 3-B), shifting the base component grid 307 into perfect alignment with the above rack extender grid 309 and allowing the beverage containers held within the compartments 308 of the extender 317 and previously resting on the sliding grid 307 to drop slightly onto the adjacent surface; the entire rack 316 (including extender 317) is then lifted vertically away from such adjacent surface, leaving the beverage containers behind resting on such surface; and finally, handle 302 is pushed back into the closed and locked position, and the foregoing process is repeated.

It is common in the industry to place clean beverage containers such as beverage containers on rubber mats for drying before use. In accordance with the above-mentioned process for use of a dishwasher rack 316, which includes a mechanism for quickly emptying the rack, it is preferred that, to prevent breakage of beverage containers, the rack 316 be placed onto a rubber drying mat before emptying the rack of glasses or other beverage containers.

Figure 4:
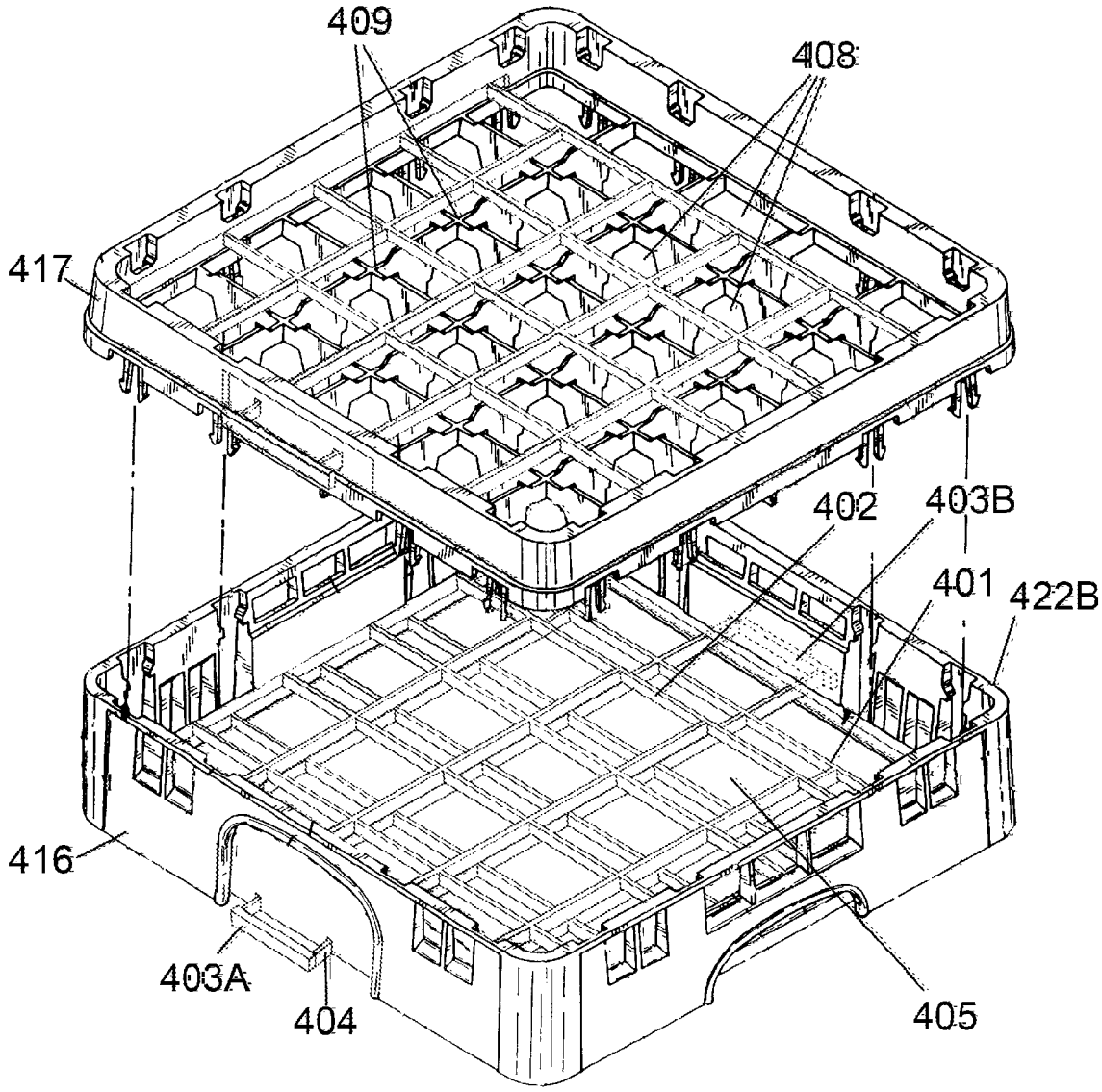
FIG. 4 is an exploded view of a dishwasher rack having two movable grids in its base portion.

FIG. 4 illustrates a rack 416 according to another embodiment of the present invention. Rack 416 preferably is similar to rack 316 (e.g., using any of the same general structure, dimensions and/or materials mentioned above and having any of the features and variations described above). For instance, like rack 316 the floor of rack 416 is not fixed or integral with rack 416. Differing from rack 316, the floor of rack 416 is comprised of two sliding grids 401 and 402, with one slightly above the other. Both grids 401 and 402 are independent and not directly connected to one another. Grid 401 is attached to a handle 403B and grid 402 is attached to handle 403A, handle 403B being on the opposite side of rack 416 from handle 403A and on the outer side of wall 422B of rack 416.

The present method for the operation of rack 416 (containing two sliding grids) is identical to the method for operating rack 316 with one main difference; after the dishwasher cycle has been completed and rack 416 is removed and placed onto a desired surface; both lower handles 403A and 403B are firmly grasped, lifting the plunger 333, engaging the flat iron latch 337 and disengaging the catch 341; both handles 403A and 403B are then pulled in opposing directions and away from the rack 416 causing the independently sliding grids 401 & 402 to move into alignment with one another and to align perfectly with the above matrix of the dividers 409 of the rack extender 417 so that no members of grids 403A or 402B are covering any lower openings to compartments 408, thereby allowing the beverage containers contained within the compartments 408 of rack 416 to drop slightly through the bottom of the rack 416 onto the adjacent surface.

Alternate Configurations

In the embodiments described above, three approaches have been described for selectively controlling whether a top or bottom surface of a dishwasher rack is sufficiently open to allow the beverage containers to pass through—a slidable set of parallel bars, a removable panel, and a slidable grid or set of grids. As indicated above, in certain embodiments another important consideration is that this controllability is capable of being exercised when the subject surface is adjacent and very close to a second surface (e.g., no more than 1-2 inches away), so that the beverage containers can drop down onto the second surface. The section below describes a number of other structures for selectively opening and closing the top or bottom surface of a dishwasher rack in accordance with these features.

Figure 5:
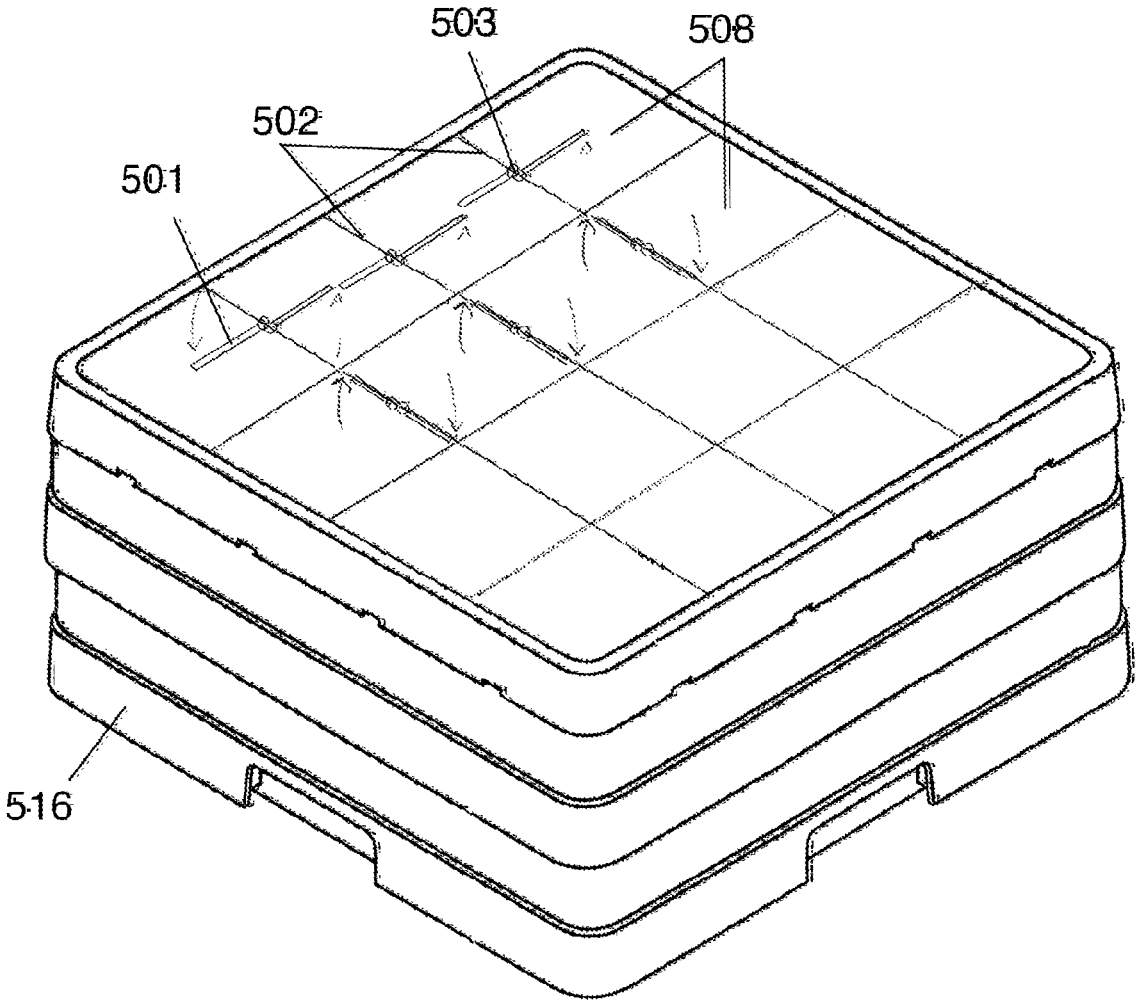
FIG. 5 is a perspective view of a dishwasher rack having separate rotating tines.

1. FIG. 5: Tines 501 built into the top of the sidewalls 502 of each compartment 508, held by a center shaft 503 and having gears connected to the shaft and to a drive system of jointed shaft are made to pivot (i.e., rotate) toward the center of each compartment opening 508 to obstruct the opening of each compartment 508 securely holding the contents of each compartment 508 into the dishwasher rack.

Figure 6:
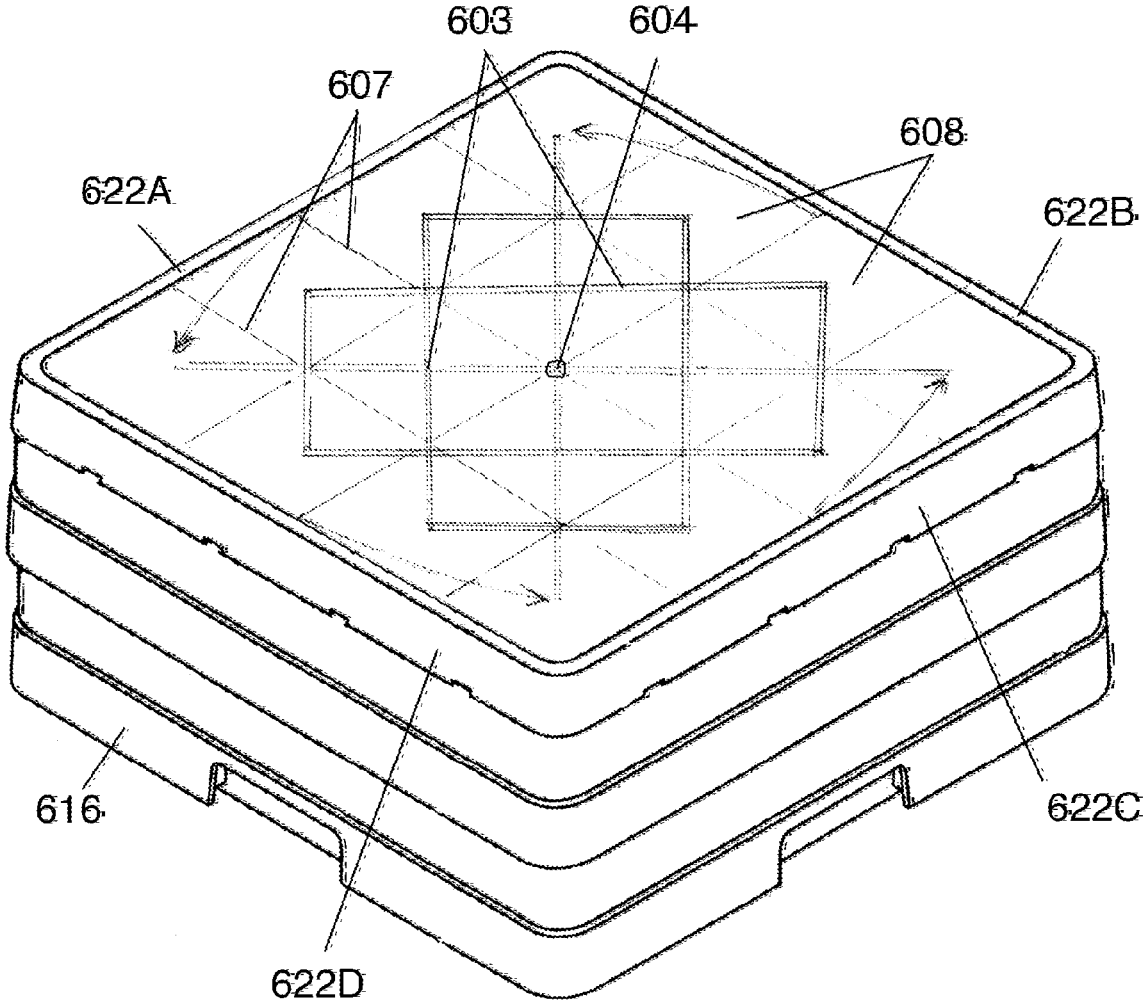
FIG. 6 is a perspective view of a dishwasher rack having a rotating grid.

2. FIG. 6: The topmost part 603 of the grid 607 that creates the compartments 608 is a separate section and not made integral with grid 607 or the walls 622A or 622B or 622C or 622D of rack 616. This top and rotatable grid 603 is attached to the rack 616 by a center shaft 604 that runs through the height of the rack 616 from top to bottom. The topmost section of the rotatable grid 603 is fixed to the shaft 604 and can be rotated by hand by grasping the grid 603 and rotating it manually, or grid 603 may be rotated by turning a knob that lays flush with the bottom surface of the base of rack 616 and therefore may be accessed when rack 616 is inverted. When in the open position, grid 603 is rotated on the center shaft 604 such that grid 603 aligns perfectly with the divider grid 607, allowing beverage containers to be loaded into the rack compartments 608. In the closed position the rotating grid 603 is rotated out of alignment with the lower divider grid 607, e.g., by ⅛ turn in a clockwise direction (as depicted in FIG. 6). The misalignment of the rotatable grid 603 completely obstructs the compartment 608 openings, locking or securing the contents of each compartment 608 into the rack 616.

When using rack 616, rotatable grid 603 is first rotated into the open position so that the compartment 608 openings are not obstructed; beverage containers are loaded into the compartments 608 of rack 616; when rack 616 is full, grid 603 is rotated into the closed position; rack 616 is then placed into an automatic dishwasher and the wash cycle is imitated; when washing is complete, rack 616 is removed from the dishwasher, inverted or turned upside down, and then placed onto a desired (e.g., flat) surface; in the upside down position, the beverage containers within rack 616 are resting on and held into rack 616 by the rotatable grid 603; with rack 616 resting on the flat surface the knob that is flush on the bottom of rack 616 and is attached to the center shaft 604 that attaches to the rotatable grid 603 is then turned, in turn moving the rotatable grid 603 into the open position and bringing the grid 603 into perfect alignment with grid 607; this movement of the rotatable grid 603 into the open position allows the beverage containers that were resting on the rotatable grid 603 to drop out of rack 616 and fall slightly coming to rest on the flat surface; then rack 616 is lifted vertically away from the flat surface leaving behind the beverage containers 3. FIG. 7-A and FIG. 7-B: A dishwasher rack extender 712 is fitted with parallel dividing supports 717, which are mounted to a gear mechanism built in the walls of the rack 722C and 722D. The gear assembly is attached to a sliding switch 713, exposed by slot 721, that when activated will engage the gears and rotate the gears in turn rotating the dividing supports 717. Two of the dividing supports 717A and 717B are built into the walls 722A and 722B, respectively, of the rack extender 712, so that in the open position each such support is vertically aligned with its corresponding inner wall 722A or 722B of the rack extender 712 and lay flush and slightly within its corresponding wall 722A or 722B. In the open position, the dividing supports 717 of the rack extender 712 align vertically, as in FIG. 7-B, allowing cups, glasses or other beverage containers to be loaded into the rack. In the closed position, the parallel dividing supports 717 have rotated to a horizontal position, as show in FIG. 7-A, effectively obstructing the openings of the compartments of the rack and locking the contents of the rack into the rack.

Figure 8:
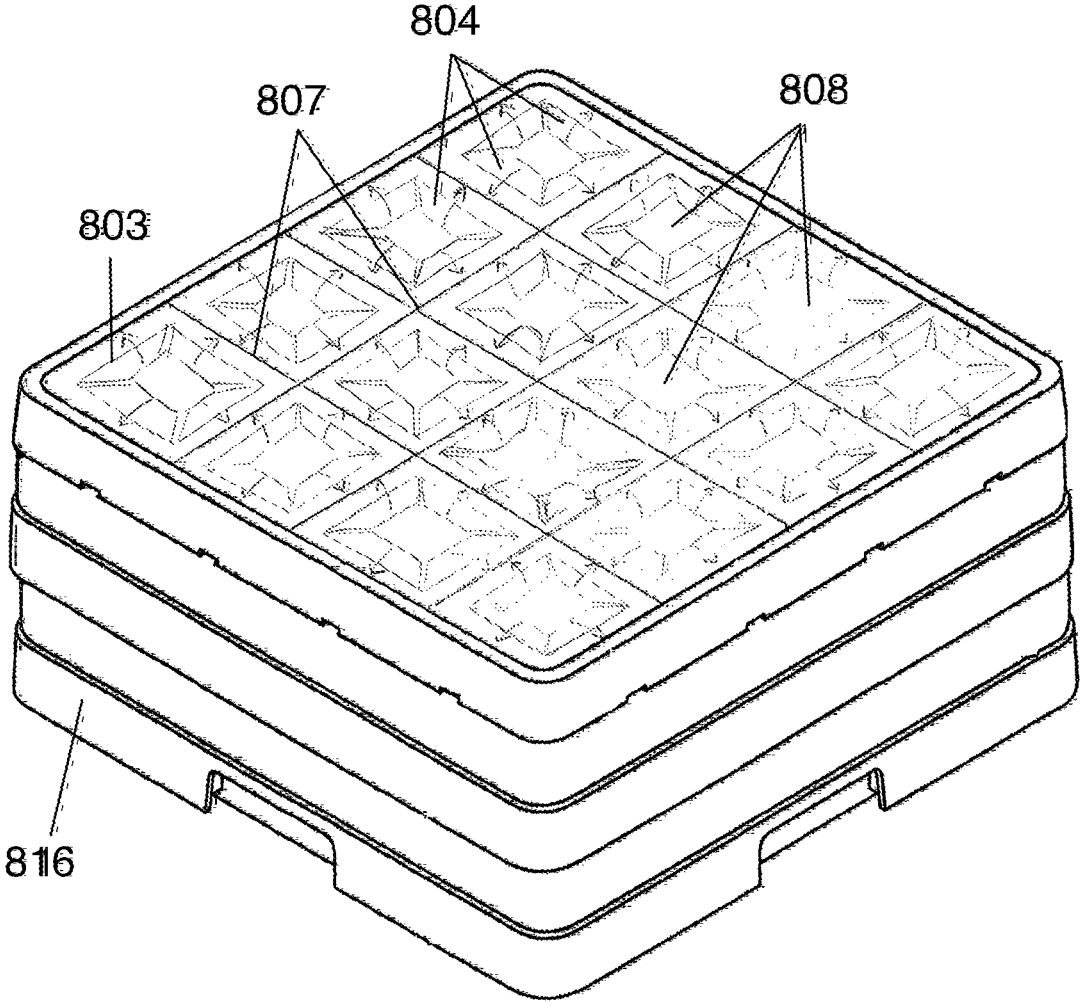
FIG. 8 is a perspective view of a dishwasher rack having flaps that fold or rotate up and down.

4. FIG. 8: The compartment dividers 807 are provided with flaps 804 on all four sides of each compartment 808. These flaps 804 are made to move on hinges 803 by the activation of an array of gears and rods connected by universal joints. When in the closed position, the flaps 804 hinge from the base of each flap and are folded inwardly toward the center of the compartment 808, thereby covering the opening to the compartment 808 from four sides, obstructing the compartment opening 808, and holding the contents of the compartments into the dishwasher rack 816.

Figure 9:
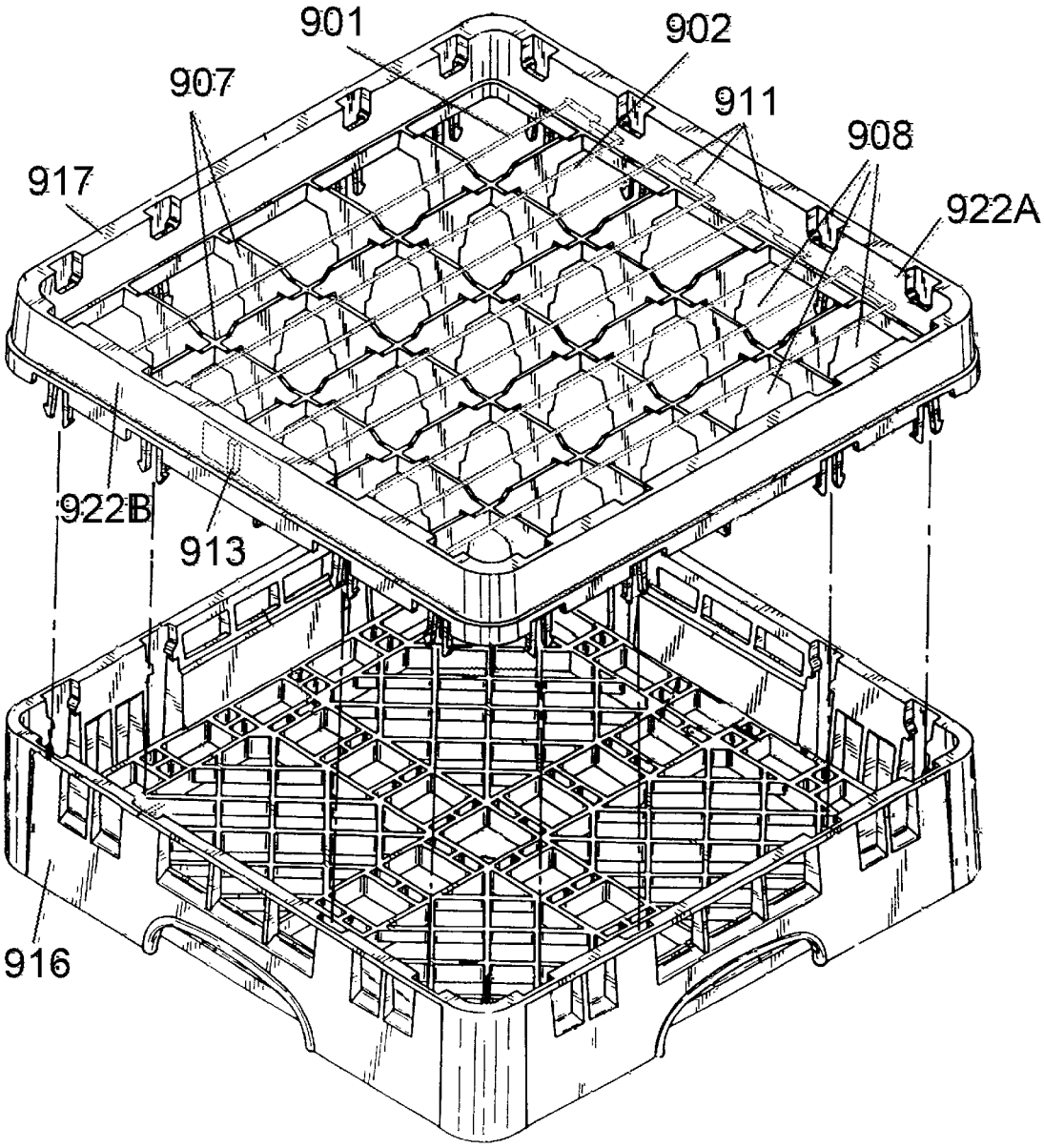
FIG. 9 is an exploded view of a dishwasher rack having two movable sets of parallel rods in its rack extender.

5. FIG. 9: A grid is formed by two sets of parallel rods 901 & 902 (or other elongated members) in the top of the extender 917 of the dishwasher rack 916 above the divider elements 907 and above the top of the openings (or compartments) 908 of the grid of the elements 907. Each set of parallel members 901, 902 is made to slide independently and in the opposite direction of the other set of parallel members along slots 911 in the sidewalls 922A & 922B of the rack 916 and is attached to an independent carrier, such as carrier 60 shown in FIG. 1-C, that is secured to and operated by a sliding tab 913. In the closed position, the parallel members 901 & 902 obstruct each compartment openings 908 at an even interval across all compartments. In the open position the parallel members 901 & 902 slide one group 901 toward the second group 902 and come into alignment together with the compartment grid 907 of the uppermost dishwasher rack extender 917. In the open position the parallel rods 901 & 902 are not obstructing any compartment openings 908 of the dishwasher rack extender 917 allowing any beverage container to pass freely out of the top of the dishwasher rack 916 unobstructed.

6. A grid is formed by two intersecting sets of parallel members. Each parallel set slides independently of the other set of parallel members. In the closed position the crossing members intersect in the center of each compartment of the dishwasher rack, fully obstructing the compartment and locking or securing the contents of the compartment into the dishwasher rack. In the open position the crossing members intersect in alignment with the grid that makes up the compartments of the dishwasher rack. The alignment of the crossing members matches exactly with the alignment of the compartments, allowing a beverage container placed into the compartment of the dishwasher.

Figure 10A:
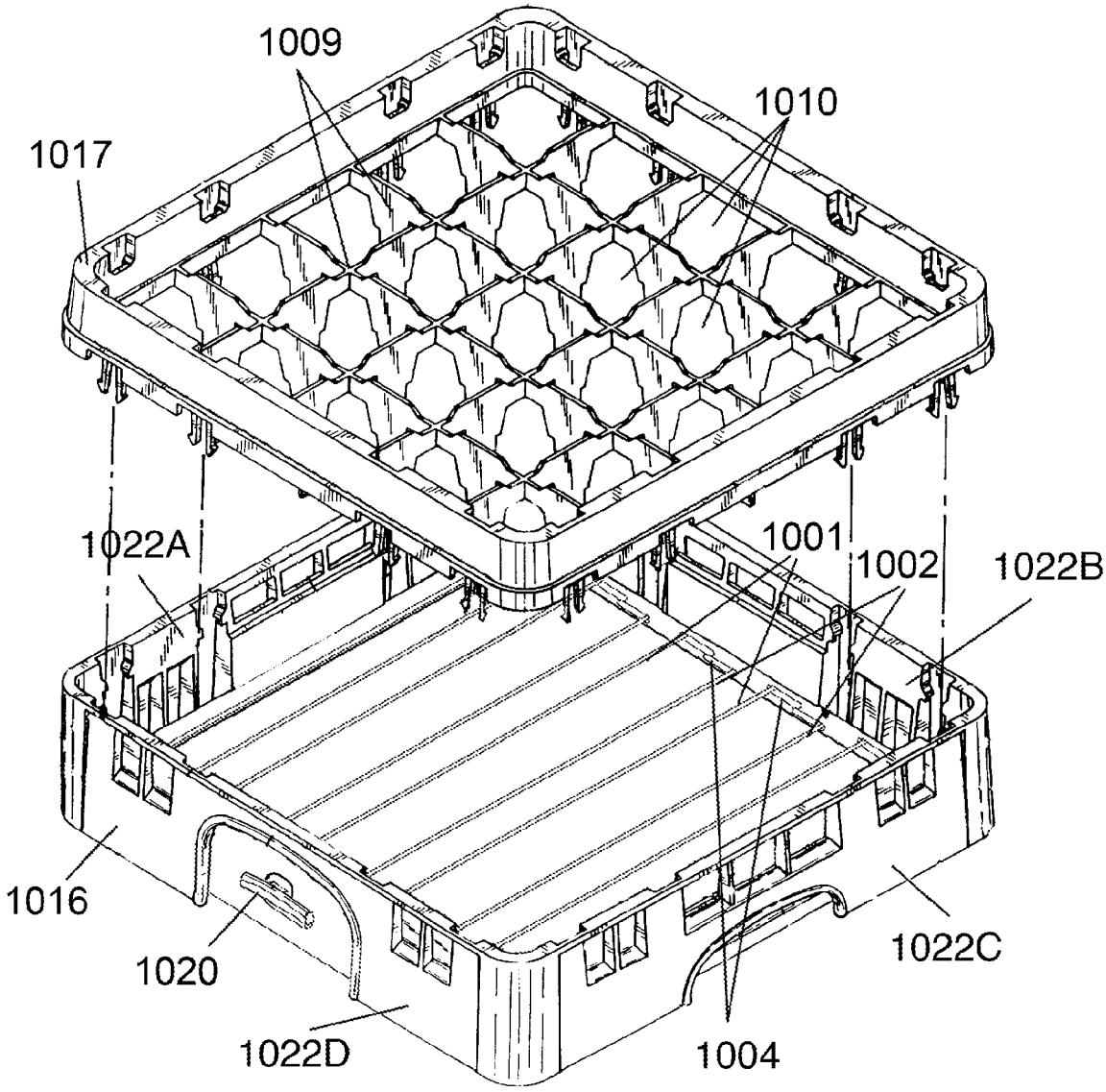
FIGS. 10A&B are exploded views of a dishwasher rack having two movable sets of parallel rods in its base component.
Figure 10B:
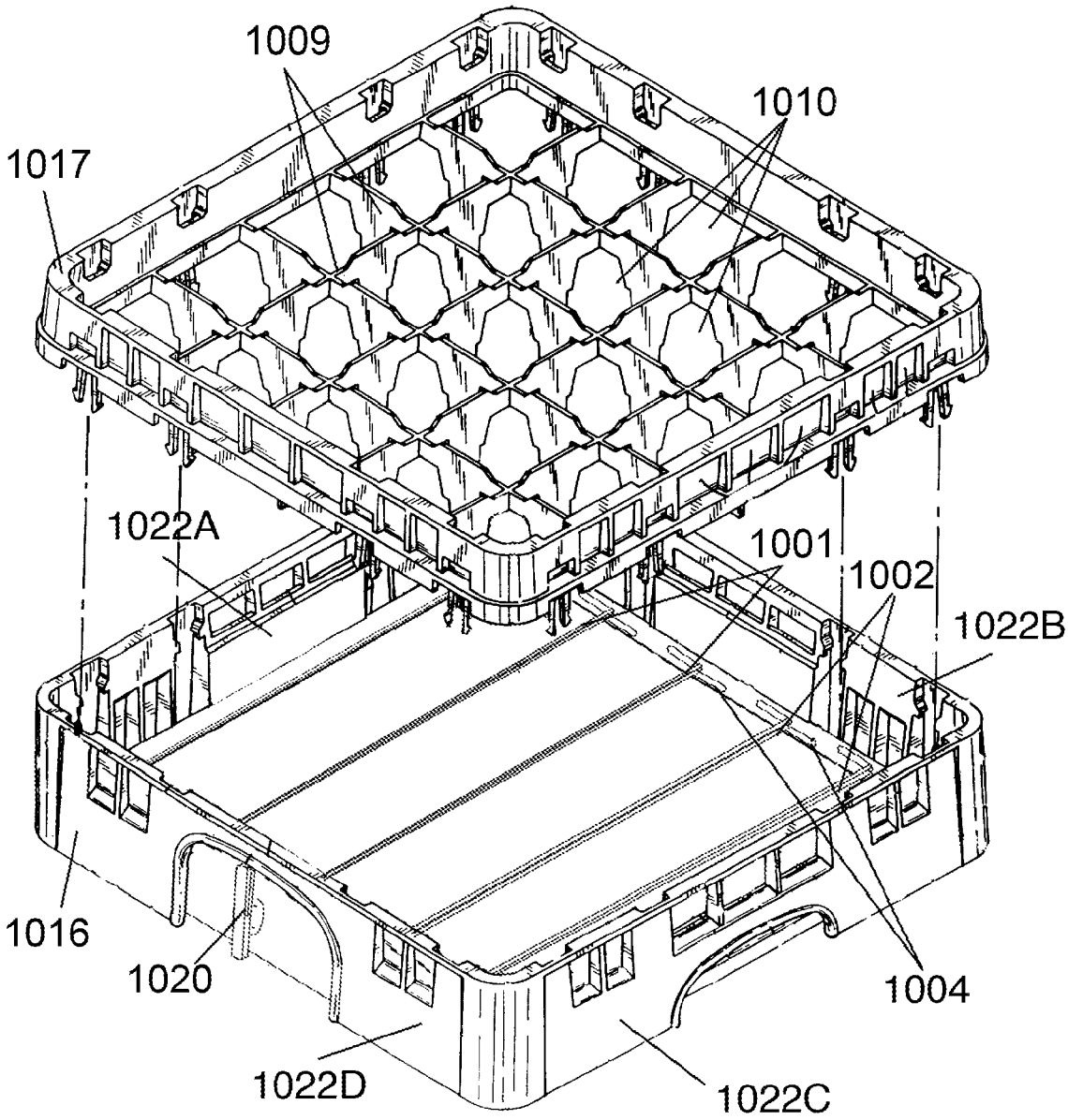

7. FIGS. 10A & 10B: similar to rack 46 but having one additional set of movable parallel members; A strong floor is formed in the base component of rack 1016 by two movable sets of parallel members 1001 & 1002. The members 1001 and 1002 align across the lower openings of the compartments 1010 that are formed by the compartment grid 1009 and obstruct the lower openings of the compartments 1010 such that any beverage container placed into any one of the rack compartments 1010 will come to rest and be supported by members 1001 and 1002. The supporting grid is in exact (or at least close) alignment with and has the exact (or at least approximately the same) dimensions as the grid that defines the compartments 1010 of the dish rack extender 1017 above. Each parallel set of members (e.g., 1001) is made to slide independently and in the opposite direction of the other set of parallel members (e.g., 1002) and is moved by operation of handle 1020 which engages an array of gears within the walls 1022D and 1022B of rack 1016, moving carriers that attach to the movable members through slots 1004 in the lower parts of inner walls 1022D and 1022B of rack 1016. In the closed position, represented in FIG. 10A, the parallel members 1001 and 1002 obstruct each compartment opening 1010 at an even interval across all compartments 1010 of the rack extender 1017. In the closed position, any beverage containers contained within compartments 1010 of the rack 1016 will rest on two of the evenly spaced parallel members 1001 & 1002. When the handle 1020 is operated and moved into the open position, as show in FIG. 10B, the parallel members 1001 & 1002 slide toward one another to come into alignment with the grid 1009 that makes up the compartments 1010 of the dishwasher rack extender 1017. In the open position the crossing members 1001 & 1002 are not obstructing any compartments 1010 of the dishwasher rack extender 1017 and allow any beverage containers to pass completely through the rack freely.

Representative Control Mechanisms

Any of the mechanisms described herein for selectively securing beverage containers into a dishwasher rack may be used in any combination with any of the devices described herein for controlling such selectivity, such as any of the following:

1. A lever built into the outer wall of the dishwasher rack is pulled or pushed, engaging an array of gears or rods causing the mechanism to move into the open or closed position or causing a motor or servo or actuator to be engaged to move the mechanism from the open to the closed position and from the closed to the open position.

2. A sliding latch between the inner and outer wall of the dishwasher rack is slid to the open or to the closed position, engaging a carrying device, a gear array, or push rods to open or close the compartments in the dishwasher rack.

3. A knob is rotated engaging a gear array, or turning a shaft to open or close the compartments in the dishwasher rack.

4. A button or switch built into the outer wall of the dishwasher rack is pushed, engaging a motor, servo or actuator that engages a gear array, or turns a shaft to open or close the compartments in the dishwasher rack.

5. A panel is pulled out of or pushed into a receiving slot by hand to uncover or cover dishwasher rack compartments.

Additional Considerations.

Some of the above embodiments employ mechanisms and configurable surfaces used to secure beverage containers into dishwasher rack by covering the top of the dishwasher rack compartments to allow the rack to be inverted without having the contents of the rack fall out of the compartments of the dishwasher rack, and then to release the beverage containers when the rack is completely inverted and in the desired position.

Other embodiments employ mechanisms and configurable surfaces in the floor of the dishwasher rack so that beverage containers loaded into the rack compartments rest on the configurable surface in its closed position in the usual way as when using a conventional dishwasher rack commonly found in the industry. When the configurable surface in the floor of the rack is then opened, the beverage containers in the rack are allowed to pass through the bottom of the rack, allowing the rack to be quickly emptied from a standard upright position.

In still further embodiments, any of such mechanisms and configurable surfaces used to cover the compartments of the dishwasher rack are provided in both the top and the bottom of the rack and/or selectively used in either the top or the bottom of the rack. In certain embodiments, the two mechanisms will work in unison to allow the contents of the rack to be locked and held into the compartments of the rack, while allowing for the release of the contents of the compartments of the rack through the floor of the rack while the rack is in the upright position.

In certain cases it is advantageous to provide a configurable (e.g., releasable) surface in a dishwasher rack extender only. Automatic dishwasher rack extenders are commonly used in the industry to increase the wall height of dishwasher racks by stacking multiple extenders together. A dishwasher rack extender having a configurable top surface according to the present invention allows the use and corresponding advantages of the present invention with dishwasher racks that are currently in use, e.g., by simply attaching such a rack extender to a conventional dishwasher rack.

All of the stated variations of the invention for securing beverage containers into a dishwasher rack preferably are used with a latch, lock or other securing device so the mechanism may be locked in the closed position. Such a securing device prevents the weight of the beverage containers and/or the movement of the full rack by being carried from causing the mechanism to open unintentionally (e.g., without being operated by user).

In the above disclosure, the invention is described with reference to the attached drawings. However, it should be understood that the drawings merely depict certain representative and/or exemplary embodiments and features of the present invention and are not intended to limit the scope of the invention in any manner.

Any of the configurable surfaces and other mechanisms described herein may be used in the base component or in the rack extender portion of a rack. Any descriptions of a particular mechanism being incorporated into one such component should be understood as being merely exemplary. Also, although the present disclosure largely pertains to dishwasher racks having compartments for holding beverage containers, the configurable surfaces and other mechanisms of the present invention can be incorporated into embodiments of dishwasher racks that are configured for washing any other type of container, plate, utensil or other article, and such racks often will have separate compartments, slots or other structures for holding the individual articles and/or for holding multiple similar articles. The types of configurable surfaces that are preferable for each such embodiment often will depend upon the shapes and/or sizes of any such compartments, slots or other structures and/or upon the shapes and/or sizes of any items included within the rack. For example, where a slot is used to accommodate a plate, there often will be a preference toward using movable rods or other elongated members that are oriented perpendicular to such slots.

Many different embodiments of the present invention are described above, with each such embodiment described as including certain features pertaining to a commercial dishwasher rack. However, it is intended that the embodiments of the invention described herein not be confined only to use in conjunction with dishwasher racks, but any embodiment of the invention, including any mechanism or method for use, may be used in conjunction with any other box, bin, rack or other container for storage or transportation having walls and a floor, whether or not including separate compartments and irrespective of the size(s) and/or shape(s) of any such compartments. Any such container in accordance with the present invention preferably includes at least one configurable surface (e.g., having any of these structures described above) as its top and/or bottom surface.

In the event of any conflict or inconsistency between the disclosure explicitly set forth herein or in the attached drawings, on the one hand, and any materials incorporated by reference herein, on the other, the present disclosure shall take precedence. In the event of any conflict or inconsistency between the disclosures of any applications or patents incorporated by reference herein, the more recently filed disclosure shall take precedence.

In the above discussion, certain methods are explained by breaking them down into steps listed in a particular order. However, it should be noted that in each such case, except to the extent clearly indicated to the contrary or mandated by practical considerations (such as where the results from one step are necessary to perform another), the indicated order is not critical but, instead, that the described steps can be reordered and/or two or more of such steps can be performed concurrently.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

In the discussions above, the words "include", "includes", "including", and all other forms of the word should not be understood as limiting, but rather any specific items following such words should be understood as being merely exemplary.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention are to be considered as within the scope thereof as limited solely by the claims appended hereto.

What is claimed is:

1. A dishwasher rack, comprising:

an interior structure divided into separate compartments, each of said compartments sized and configured to hold an individual beverage container;

an outer wall that encloses said interior structure;

a top side through which the compartments may be loaded;

a bottom side having a support surface; and a release mechanism, wherein at least one of the top side or the bottom side has a configurable surface that provides a closed configuration in which said configurable surface is capable of supporting a plurality of beverage containers and an open configuration in which said beverage containers are able to pass through said configurable surface, wherein when said dishwasher rack is placed on top of a desired exterior surface with the configurable surface immediately adjacent said exterior surface, the release mechanism can be operated to change the configurable surface from the closed configuration to the open configuration, causing any enclosed beverage containers to drop down onto the exterior surface and remain there when the dishwasher rack is lifted up and away, wherein the release mechanism comprises a hand grip that attaches to the configurable surface through an opening in the outer wall, and wherein said hand grip allows a user to slide the configurable surface between the open configuration and the closed configuration while the configurable surface remains confined within the outer wall.

2. A dishwasher rack according to claim 1, wherein the configurable surface is the support surface of the bottom side.

3. A dishwasher rack according to claim 1, wherein the configurable surface is located on the top side.

4. A dishwasher rack according to claim 1, comprising a base component that includes the bottom side and a separate extender component that is attached to the base component and includes the top side, and wherein the configurable surface is located on the top side.

5. A dishwasher rack according to claim 1, wherein the configurable surface comprises a structure that moves between: (1) a first position in alignment with sidewalls of the compartments, corresponding to the open configuration; and (2) a second position that blocks openings to the compartments, corresponding to the closed configuration.

6. A dishwasher rack according to claim 5, wherein the hand grip comprises a slidable tab.

7. A dishwasher rack according to claim 5, wherein the configurable surface slides in a single direction between the first position and the second position.

8. A dishwasher rack according to claim 1, wherein the hand grip comprises a handle.

9. A dishwasher rack according to claim 1, wherein each of the top side and the bottom side includes a said configurable surface.

10. A dishwasher rack according to claim 1, wherein the desired exterior surface is a flat surface.

11. A dishwasher rack according to claim 1, wherein a first grid divides the interior structure into said separate compartments and the configurable surface comprises a second grid having the same dimensions as the first grid.

12. A dishwasher rack according to claim 5, wherein a grid divides the interior structure into said separate compartments and said structure of the configurable surface has the same spacing as said grid.

13. A dishwasher rack extender, comprising:

an interior structure divided into separate compartments, each of said compartments sized and configured to allow an individual beverage container to pass through;

an outer wall that encloses said interior structure;

a bottom side that is configured for attaching to a dishwasher rack base component;

a top side opposite the bottom side and having a configurable surface that provides a closed configuration in which said configurable surface is capable of supporting a plurality of beverage containers and an open configuration in which said beverage containers are able to pass through said configurable surface; and a release mechanism, wherein the release mechanism can be operated to change the configurable surface from the closed configuration to the open configuration, wherein the release mechanism comprises a handle that attaches to said configurable surface through an opening in the outer wall, and wherein said handle allows a user to slide said configurable surface between the open configuration and the closed configuration while said configurable surface remains confined within the outer wall.

14. A dishwasher rack according to claim 11, wherein in the open configuration the second grid is in alignment with the first grid, and wherein in the closed configuration the second grid is offset from the first grid, thereby obstructing openings to all the separate compartments.

15. A dishwasher rack according to claim 1, wherein when moved into the closed configuration, the configurable surface locks into place.

16. A dishwasher rack according to claim 1, further comprising a second configurable surface that can be operated in conjunction with the configurable surface, wherein in the open configuration both the configurable surface and the second configurable surface are in alignment with sidewalls of the compartments, and wherein in the closed configuration both the configurable surface and the second configurable surface block openings to the compartments.

17. A dishwasher rack according to claim 16, wherein the second configurable surface is disposed slightly above the configurable surface.

18. A dishwasher rack according to claim 1, wherein the second configurable surface can be slid independently of the configurable surface using a second hand grip that attaches to the second configurable surface through an opening in the outer wall while the second configurable surface remains confined within the outer wall.

* * * * *